US008049090B1

(12) United States Patent
Voit

(10) Patent No.: US 8,049,090 B1
(45) Date of Patent: Nov. 1, 2011

(54) APPARATUS AND METHOD FOR ACTUATING KEYBOARD MECHANISMS AND EVALUATING THEIR MECHANICAL PROPERTIES AND STROKE CHARACTERISTICS

(76) Inventor: Hugh Richard Voit, Chicago, IL (US)

( * ) Notice: Subject to any disclaimer, the term of this patent is extended or adjusted under 35 U.S.C. 154(b) by 131 days.

(21) Appl. No.: 12/402,487

(22) Filed: Mar. 11, 2009

Related U.S. Application Data

(60) Provisional application No. 61/035,438, filed on Mar. 11, 2008.

(51) Int. Cl.
*G10D 13/02* (2006.01)

(52) U.S. Cl. ..... 84/423 R; 84/433

(58) Field of Classification Search ..... 84/423 R, 84/433, 436, 439, 442, 445
See application file for complete search history.

(56) References Cited

U.S. PATENT DOCUMENTS

2009/0282962 A1* 11/2009 Jones et al. ..... 84/21

OTHER PUBLICATIONS

Gillespie, Brent, Dynamical Modeling of the Grand Piano Action, Proceedings of the International Computer Music Conference (San Jose, California), Oct. 1992, pp. 77-80, ICMA, Inc., San Francisco, California (also published as: Stanford University Department of Music Technical Report STAN-M-80, Stanford University, Oct. 1992).

Hickman, Clarence, Description of the New Piano Action, Ampico Research Laboratory, circa 1929, (reprinted from Mechanical Music Digest Compilation, copyright 1995-2008 by Jody Kravitz; http://www.mmdigest.com/Tech/HickmanAction/description.html).

Hirschkorn, Martin C., Dynamic Model of a Piano Action Mechanism, 2004, University of Waterloo, Waterloo, Ontario, Canada.

The Leveler Company, QuicKey Leveler (flyer), 2007-2008, The Leveler Company, Naperville, IL.

The Leveler Company, Regulate Like a Concert Technician, 2009, www.levelwithme.net/gpage6.html, The Leveler Company, Naperville, IL.

"Pin joint for the Hickman grand piano action, from Nelson Barden's 1969 interview with Dr. Hickman, Also reproduced in book "The Ampico Reproducing Piano" ed. By Richard J. Howe, publ. by MBSI 1987, p. 92" (reprinted from Mechanical Music Digest Compilation copyright 1995-2008 by Jody Kravitz; http://www.mmdigest.com/Tech/ HickmanAction/pinjoint.html).

Suzuki, Hideo and Nakamura, Isao, Acoustics of Pianos, Applied Acoustics, 1990, pp. 147-205, vol. 30, Great Britain (excerpt pp. 147, 155-7).

* cited by examiner

*Primary Examiner* — Kimberly R Lockett

(57) ABSTRACT

New parameters (Down Force, Up Force, Balance Force, and Average Friction) are defined for evaluating important "stroke characteristics" of individual key actions of one or more pianos or keyboards, describing exactly how these parameters are to be tested, measured and determined. The new parameters are designed to replace the prior art parameters of Down Weight, Up Weight, Balance Weight and Friction. Various methods, means and apparatus are disclosed for accurately testing, measuring and determining these new parameters, with the capability of performing thousands of measurements—on thousands of different key mechanisms—in a short amount of time.

22 Claims, 23 Drawing Sheets

RA

APPARATUS AND METHOD FOR ACTUATING KEYBOARD MECHANISMS AND EVALUATING THEIR MECHANICAL PROPERTIES AND STROKE CHARACTERISTICS

CROSS-REFERENCES TO RELATED APPLICATIONS

This application claims priority to US Provisional Patent Application Ser. No. 61/035,438, filed Mar. 11, 2008.

INCORPORATION-BY-REFERENCE OF MATERIAL SUBMITTED ON A COMPACT DISC

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to piano key mechanisms, and more specifically to improvements in measuring the performance characteristics of key mechanisms of a piano or keyboard.

2. Background Art

As an aid to the following prior art discussion, a brief description of the two basic piano actions follows.

FIGS. 1, 1A, 2 and 2A demonstrate operation of a prior art grand piano action 100. For the purpose of better understanding, with reference to these figures, the following components remain stationary with respect to the piano during a sequence of key depression through hammer strike and return: hammershank flange 134, hammershank flange center pin 136, repetition support center pin 112, key fulcrum 104, key pin 106, drop regulation screw 196, jack let-off button 170 and string 140. With respect to FIGS. 1 and 2, the "back" of the key or action is to the left in the figures. The "front" of the key or action is to the right. Still referring to FIGS. 1 and 1A, the prior art grand piano action 100 is shown in the "at rest" position. Wooden key 102, approximately 15 inches long, is mounted to pivot on felt-covered, wooden fulcrum 104 and brass pin 106 extending through a vertical slot (not visible in the figures) in key 102. Wippen 110 is mounted for rotation about metal center pin (a fixed pivot point) 112. Two levers are mounted to rotate independently within the repetition assembly: an L-shaped jack 120 mounted to rotate about center pin 121, and repetition lever 123 mounted to rotate about center pin 114. Felt hammer 130 is fixedly mounted at the free end of wooden shank 132, and wooden shank 132 is mounted to rotate about center pin 136, held stationary by flange 134. As the hammer 130 is rotated upwardly, it strikes tensioned piano string 140 to create vibration and sound. Affixed to hammershank 132, between hammer 130 and center pin 136, is buckskin covered cylindrical knuckle 150, engaged upon the top end surface 128 of the upper arm 122 of the jack 120. The jack 120 is maintained in the "at rest" position shown in FIGS. 1 and 1A by action of a lower end of return spring 160, which bears against the rear surface 129 of the jack, thus urging it to rotate backward (counter-clockwise in the drawings), about center pin 121, until the felt regulating button 162 (mounted on the upper jack arm 128) is brought into contact with the rigid metal spoon 164 (mounted to wippen 110). The upper end of return spring 160 biases the forward end of repetition lever 123 to rotate upwardly, about center pin 114, until the pad 166, mounted at the front end of repetition lever 123 is brought into contact with the wippen 110.

Also shown in FIG. 1, but left out of FIG. 2 for clarity, is the damper assembly 198. The damper assembly of a piano provides additional resistance to the stroke unless the sustain pedal is depressed. Pressing the pedal disengages the damper lever entirely from the key. All of the Up Weight and Down Weight measurements are done with the damper lever disengaged. All new methods by the present author, designed to replace these old parameters, are also done with no dampers involved.

We refer next to FIGS. 2 and 2A (in which the position of the action 100 in the "at rest" position of FIG. 1A is indicated in dashed line for ease of reference). Upon depression of the key 102 (indicated by arrow 180), wippen 110 is moved upwardly, to rotate (arrow 182) around center pin 112, thereby actuating the various interengaged elements of the repetition assembly (i.e. wippen 110, jack 120, repetition lever 123, spring 160, regulating button 162 and spoon 164) and moving the hammer 130 towards striking engagement with the piano string 140. In particular, movement of the jack 120 urges the knuckle 150 upward and to the left (in the drawings), causing the hammershank 132 to rotate about center pin 136, driving the hammer 130, at the free end of the hammershank, upward and to the left, toward the piano string 140 (arrow 184). During movement of the knuckle 150 upward and to the left, the engagement of the knuckle surface with the top end surface 128 of the jack 120 creates excessive friction, which has the recognized consequence of requiring a pianist to apply additional force in order to achieve the desired key depression. Approximately midway through full depression of the key 102, the outer end of the lower arm 126 of jack 120 is brought into engagement with stationary let off button 170. At this point, a significant "let-off" resistance is encountered, but this is of little consequence when it comes to evaluating the Down Weight and Up Weight of a piano action. When the key nears the bottom of its stroke, the felt pad at the front rail is compressed between the key bottom and the keybed, eventually ending the downstroke.

FIGS. 3 and 4 represent a side view of a typical upright piano action. The majority of a piano key 1 is not shown, along with the fulcrum upon which the key pivots. A downward movement of the piano key 1 causes a capstan screw 22 mounted on key 1 to raise upwardly and engage a cushion 23 of a wippen 24 mounted for pivotal movement about a center pin 25. This causes wippen 24 to be raised, thereby also imparting a corresponding raising of a jack 2, the latter in turn causing a simultaneous thrust of a hammer 3 in the direction of a piano string 4. As key 1 is depressed, string 4 is freed from a damper 5 by the action of a spoon 6, so that once the hammer 3 hits the string 4, the latter will be free to vibrate. A sustain pedal (not shown) independently rotates the damper about its pivot 32, preventing contact from occurring with the spoon 6. An escapement is realized immediately prior to hammer 3 hitting string 4 because a toe 7 of the lower end of jack 2 engages a regulating button 8. This causes jack 2 to rotate clockwise, and a tip 13 at the upper end of jack 2 disengages from a butt 11 of hammer 3, thereby permitting hammer 3 to freely pursue its movement. Once escapement is triggered, key 1 also continues its downward movement independent of hammer 3, until the key bottoms out on the key bed (not shown). When hammer 3 strikes string 4 and is propelled rearwardly, key 1 remains fully depressed and a butt heel 10 mounted on an arm 18 of hammer 3 engages a back check 9 which remains in a raised position. As also shown in FIGS. 3 and 4, damper 5 includes a felt 26 for engaging string 4 and an associated drum block 27 and set screw 28. Damper 5 is mounted on a lever 29 which in turn is mounted to a lever flange 31 for pivotal movement about a center pin 32. Hammer rest 12 includes a felt 34 for engagement by hammer 3 and an associated half blow rest rail 35 and a rest rail 36. Butt heel 10 is provided with an associated butt heel leather 37 and a bridle wire 39. Jack 2 is mounted to wippen 24 by a flange 21 for pivotal movement about a center pin 20. Pivotal movement of jack 2 is biased by a spring 40. Regulating button 8 is mounted to a regulating rail 41 and there is provided a main action rail 42.

A. Measuring Down Weight and Up Weight

Traditionally, the "static feel" of the key mechanism (also known as the key action) of a piano is measured by a process of gradually adding or subtracting "gram weights" to/from the front end of the key, until key movement ensues. This is generally done with the sustain pedal depressed or otherwise disengaged, so that the damper lever resistance is no longer encountered in the stroke. The weights are typically placed 10 to 12 mm from the front edge of the key. This will be known as the Application Point (AP). The two quantities directly measured in this longstanding process are:

i) the minimum amount of applied weight required to make the key continuously descend all the way to a point known as "let-off", and ii) the maximum amount of weight the key is able to lift from a depressed position (normally the beginning of "let-off") to the top, rest position of the keystroke.

The quantity (i) is typically referred to as Down Weight (DW), while (ii) is called the Up Weight (UW). Both parameters are functions of gravity forces acting on the mechanism, various spring forces, friction at various points in the mechanism, and in some cases magnetic forces. DW is often used as the indicator in attempting to ensure a constant (or continuous) touch resistance across the keyboard. One of the main purposes for measuring the DW and UW is to determine still two other parameters: Balance Weight (BW) and Friction. The Balance Weight (BW) is simply the average of DW and UW. Balance Weight has the benefit of being theoretically independent of the friction in the key action. Ideally, it expresses the combined effects (at the Application Point, AP) of all the "static" force components of the mechanism (springs, gravity, magnets) except friction. For this reason, it is generally considered better to use BW, rather than DW, as the guiding parameter, when attempting to achieve a constant or continuous touch resistance across the keyboard. Friction in the key mechanism is notorious for changing quickly and randomly over time. This is usually due to warpage, shrinkage or expansion of component parts. And all this is made worse when either the humidity or temperature varies severely over time. Therefore, the fastidious piano technician has the goal of trying to ensure that the BW's of all the keys are either constant, or at least vary in a continuous manner from key to key. Regarding Friction, it is also obtained from DW and UW. Calculated Friction is simply half of the difference between DW and UW.

If the BW measurement (often DW is used to save time) is not within some specification, the remedy is often the embedding of small, lead weights (called keyleads) into the wooden keys. On a grand piano, they are usually placed in front of the balance rail. Three of them are shown in FIGS. 1 and 2 as component 172. On an upright piano, they are sometimes placed in the key behind the balance rail (i.e., behind the fulcrum relative to the player). These weights are usually added at the factory. And during a major rebuild of an action (particularly when new hammers are installed), they will commonly be replaced or re-situated. This is known as "weighing off" the keys. In some cases (depending on the piano's design), weights are added or removed from other places in the key-mechanism, like the wippen. And springs (likely attached to either the wippen or the key) are also used sometimes for the purpose of adjusting the DW and UW parameters. And occasionally, one might find pianos that use one or more pairs of magnets, whose relative spacing can also be adjusted to modify these parameters.

It should be noted that the above Prior Art methods of measuring the "feel" of the piano keys neglect that portion of the resistance due to inertia. These inertia forces are indeed felt whenever the key (and associated mechanism) is accelerated. So the type of feel that these long-used methods attempt to address is related to relatively soft playing, where acceleration is either minimal or short-lived. From hereon, I will refer to this "feel" as the Static Resistance of the key mechanism.

With regards to this longstanding practice of measuring the static values of Down Weight, Up Weight, and (indirectly) Balance Weight, the process is very tedious and time-consuming. Largely because of this, it is prone to operator error. In addition, it is prone to error just by nature of the process itself. As I will demonstrate below, the effects that the process is supposed to quantify (gravitational, magnetic, spring and frictional forces) are too often masked by limitations of the process itself.

For the Down Weight, the technician gradually adds small "gram weights" to the key near its front edge, at the AP. A complete set of gram weights contains weights of several different magnitudes, with plenty of duplicates, so that two or more weights of the same (or different) mass can be stacked onto one another. They are added until the key not only begins to move, but is also able to descend to at least the so-called "let-off" point of the stroke. The keyboard is commonly thumped by hand as each additional weight is added, apparently in an effort to see more of the kinetic friction effect, and less of the static friction (which is always higher than the kinetic). Kinetic friction is in general more consistent, which is likely why this is done. Once the key has descended fully, that particular weight/mass is recorded as the DW, along with the key number. Similarly, the Up Weight is determined by gradually removing weights from a depressed key, thumping the keybed after each removal, until the key is able to return to its top/rest position. The mass value is then recorded as the UW, along with the key number. The Balance Weight is then calculated as the simple average of Down Weight and Up Weight, as mentioned above.

One problem associated with this process, having to do with the sheer tediousness of it, is how accurate the technician can afford to be. If he's just beginning this process for an entire piano, he may start out adding (and removing) very small increments of mass (perhaps 1 gram). By the time he has completed measurements for a third, or half, of the keys, he may resort to adding/removing nothing smaller than 2 or 3 gram weights, simply to make things go quicker. So the answers, already limited by the physics of the process, are further reduced in accuracy by insufficient resolution.

The other limitation of this process—the results not truly representing the desired effects—will now be described. All of the component "static" forces which together are supposed to exclusively determine the DW and UW values can vary significantly as the stroke of a given key action proceeds. The friction occurring at the various joints/interfaces along the keystroke is certainly local in nature, and can vary as the key and action change position. Any spring, whether attached to the wippen or the key or the hammer, will also have its force varied as it is compressed or extended along the stroke. If magnets are at play, they will change distance from each other during the stroke, with corresponding changes in force or torque. And finally, the gravitational forces acting on the hammer (and to a lesser extent other masses in the mechanism) will vary throughout the stroke just based on the trigonometry of the moving levers. The resulting effect of all these components at the AP therefore changes as the key stroke progresses. The Prior Art parameters of DW and UW (and by extension, BW) exist for the sole purpose of trying to quantify these non-inertial effects. The subsequent examples will show how these parameters are in fact deficient in actually measuring that for which they were created. Note that the reasoning is nearly the same no matter which of the "force components" (friction, gravity, springs or magnets) is the culprit. However, since friction would likely behave in a more erratic manner, it will be treated separately.

(1) Description of DW & UW Measurement

Highlighting Limitation of the Process Due to Varying Friction

Once the technician has added enough weight at the AP to cause the key to start moving, the entire key assembly obtains momentum. This momentum, however small it may be, allows the descending key to overcome some or all of the localized "spikes" in friction, thus cruising right through these regions. The more momentum (or speed) it attains, the more friction it can overcome without stopping. Thus any points in the descent where higher friction might be found are effectively masked by the moving key/mass assembly. In the best scenario then, the DW represents the amount of force required to press the key down slowly, at the most resistant point in its downstroke. If only one small portion of the stroke, say near the top, contains this large friction value, the prior art Down Weight nevertheless reacts as though this frictional force is acting over the entire stroke. Perhaps even a more misleading case would exist if the friction near the very top of the stroke was relatively small, becoming larger at points further down the stroke. The prior art value of DW would thus err on the small side. This is because once enough mass is added, the key mechanism would begin moving, thus acquiring momentum. It may very well acquire enough momentum to "cruise" right on through the point(s) of higher friction further in the stroke. The result is obviously a Down Weight that is smaller than it should be, with the "sticky" region having been glossed over entirely.

The upstroke (when calculating Up Weight) has a very similar limitation, as the entire key mechanism (hammer, key, embedded keyleads and applied gram weights) begins acquiring momentum, once enough weight has been removed for ascent to begin. If friction is locally high at the point near let-off where the key stopped when evaluating the Down Weight, then considerable weight must be removed to get the key moving upwards again. And once it starts moving, the friction may decrease quickly for some or all of the remaining upstroke. Yet the Up Weight had to be "artificially" reduced to get beyond the "sticky" region near the bottom. This would lead to an artificially low value for UW. Similarly, if this bottom region happens to have a locally small friction, then less weight must be removed to get the key moving upwards. Then, the key may likely acquire sufficient momentum to "break right through" a "stickier" region closer to the top of the stroke. In this case, the Up Weight value would be artificially high.

So the measurement of DW and UW, and therefore BW and Friction, is severely impaired by the variation of the frictional component along the keystroke. If it just so happened that during the stroke, this friction component (at the AP) remained totally constant as all members moved slowly along, then these equations, and the accompanying method, would be more valid. However, it is much more likely that friction, in any number of joints/interfaces in the action, varies as the key moves along.

(2) Description of DW & UW Measurement

Highlighting Limitation of the Process Due to Changing Leverage, Magnetic Force or Spring Force Throughout Stroke The force components of gravity, springs and magnets (if they exist) are also likely to vary with key position. Of course, they will likely vary more smoothly than would friction. This is another way of saying that the TRUE Balance Weight (i.e., the induced upward force at the AP due to gravity/leverage of the entire key mechanism, springs and magnets) will often change across the keystroke. The moment arms of the various levers can change as the stroke ensues. For instance, in a grand piano, the moment of the hammer mass about its shank's pivot usually increases as the key is further depressed, just due to the trigonometry. In an action using magnets, the "assisting" force might also change somewhat as the key descends. Any springs at work would also, by their very nature, impose continuously varying assistance—or impedance—at the AP. For instance the hammer return springs in an upright piano exert less resistance at the AP at the top of the stroke than at the bottom. With current practice, the effect of all these variations can be easily missed for the same reason as varying friction can be missed: acquired momentum of the gram weights and entire key action. Once the gram weights, and indeed the entire key mechanism begin moving, subsequent increases in True BW—due to increases in these forces—can be "cruised through". As with the friction, this would lead to artificially low measured DW's. In that same scenario, where True BW is higher when the key is depressed than when the key is near its rest position, the measured UW's would be artificially high, since less weight would have to be removed to get the key moving up. As the key ascends, the decreasing upward force (at the AP) due to gravity, springs and magnets may not be able to stop the key before reaching the top. This would result in an artificially high UW.

As will later be seen in the Description section, the current practice of measuring DW and UW is also limited for a slightly different reason. In that section, a rigorous formulation of the friction equation will reveal the following:

1) If there is either acceleration or deceleration of the gram weights, on either the downstroke or the upstroke, the conditions of the governing equations will be violated, leading to inaccuracies.
2) If the velocity of the AP (i.e., of the gram weights) at the bottom of the range of interest is different that at the top, then conditions of the governing equations will have been violated, leading to inaccuracies.

Both of these scenarios are closely related to what was already discussed above, simply phrased in a more theoretical manner. In other words, during DW measurement, if the key begins descending, and reaches a nice, constant velocity at, say, 1 mm, and then encounters additional friction at, say, 4 mm, there may be enough acquired momentum to "cruise through" this region, as discussed above. But in practice, what is happening is that there is a deceleration of the gram weights, due to the increased frictional resistance. So even though the momentum may be sufficient to glide through this region without stopping, a deceleration has occurred, which violates the conditions of the governing equations.

Another limitation of the current practice has to do with the "thumping" commonly done after each gram weight is added or removed. This "thumping" of the bottom of the keybed is normally done with the fist or palm of the hand. In essence, it serves to create some small movement of the measured key. An upward thump briefly accelerates all keys in the upward direction. However, the key which already has weights on it will not accelerate upward as much as its neighbors, thus creating some relative movement of that key. This changes the friction from static to kinetic, with the latter being generally smaller. The problem is, this thumping really needs to be fairly consistent in intensity. Otherwise, a gram weight that would otherwise be sufficient to cause key depression can't because its key didn't make the transition from static to kinetic friction. All because the thumping done with that gram weight in place wasn't quite as intense as usual.

Some experiments were reported as having been performed by Clarence Hickman, using some sort of "touch analyzer" in 1929. This work is briefly described in a technical paper entitled "Description of the New Piano Action" (Description of the New Piano Action" by Clarence Hickman, Ampico Research Laboratory, circa 1929, 14 pages), which is believed to have been written by Hickman in 1929, when he worked for Ampico. According to the Ampico paper, the device sat in front of the piano and had a member that contacted the top of the key. The device also had some sort of force transducer apparently. In a 1969 interview with Bardel, Hickman was either unwilling or unable to explain how the force was measured. According to this interview, the contacting member was made to move down against the key by a "hand cranking device". Hickman managed to create some graphs of the resulting force vs. displacement as he cranked the device to make the key move down and then back up. It is unclear if anything approaching constant speed was achieved, or if Hickman was even striving for that. In both the Ampico paper and the 1969 interview, he was unable or unwilling to explain how the apparent correspondence between force and displacement was obtained in 1929. In the interview, he suggested he tried to "gently" crank the device to complete a cycle. The graphs he made do show a significant force difference between the downstroke curve and the upstroke curve. One such graph is shown in FIG. 5. This would indicate that the key had some finite speed in both directions, even if some accelerations may have been present from the hand cranking process. Hickman used this data solely to help demonstrate the superiority of his new Hickman Piano Action design. He particularly used the curves to show the reduction in friction exhibited by his design, relative to the traditional action. He mentioned in the Ampico paper that the area between the "downward" force curve and the "upward" force curve represented the work done to overcome friction. Hickman made no attempt at averaging any of the forces over the stroke. He also only seemed to use the device when the damper was fully engaged (i.e., sustain pedal not depressed). He also commented on the points in the downstroke that appeared to correspond to certain events, like damper pedal engagement, repetition lever hitting the drop screw, and contact between the jack and the let-off button. And although there is a photo of Hickman's device, the nature and operation of the device is unclear from the paper.

B. Measuring Key Dip of a Piano Key

In the Prior Art, the distance that a key can travel, measured somewhere near the front of the key, is known as the Key Dip. In the Prior Art, this parameter is not so much measured as it is checked when necessary. The two main tools used for this checking are a key dip block or a 'Jaras leveling and key dip tool'. Both of them are only good for a conditional check of a given key. That is, each tool comes in one "size", which makes it good for determining when the key dip is that one exact value. So if one uses a ⅜" key dip block, or a ⅜" Jaras tool, one can learn if the key dip is greater than, equal to, or less than this ⅜" value. If you had many tools, all configured for different values of key dip, it might be theoretically possible to determine the exact value of the key dip. But that is highly impractical. In reality, the tools are used as part of the adjusting process, rather than for measuring per se. So, the technician uses a ⅜" tool if he wants to set the key dip to ⅜", a 9/16" tool if he wants to set it to 9/16", etc. The tools are used in concert with a shimming process underneath the front of the key, adjusting shims until the key dip matches the specification of the tool. Another concern while using the tools is the amount of force to apply to the key for it to be considered in its "fully displaced" position. The standard practice is supposed to be the application of 250 grams (force) to the top of the key. This process is rather tedious work, and takes at least an hour for a typical piano.

C. Simultaneous Excitation and Force-Measurement of a Piano Key

Some experiments have been performed in which the top/front region (the "playing region") of a piano action was set into motion and a reaction force measured. As mentioned above, Clarence Hickman reportedly did this with some sort of mechanical device in 1929. As reported, he used this device on a new piano action design he had recently invented, and also on a traditional design, to demonstrate that his design produced less friction, cranking the device by hand to get the probe to move the key down, and back up again. The device was reported to have rested on a large base in front of the piano. It is unclear from the literature how Hickman was able to measure force, and furthermore how he was able to generate a graph relating force and key displacement. Several of these graphs exist, one of which is shown in FIG. 5.

As part of an effort to dynamically model the grand piano action, Brent Gillespie in 1992 authored a paper ("Dynamical Modeling of the Grand Piano Action" by Brent Gillespie, in Proceedings of the International Computer Music Conference, pp. 77-80, 1992) in which the results of his modeling were tested with some laboratory experiments. According to the paper, Gillespie excited the key and observed, through both high-speed video and position encoders on the action mechanism, the movement of various components. A strain gauge was placed between a kevlar driving member, which was coupled to a large motor, and the top of the key. This recorded the interaction forces. The description of the apparatus is not clear in the paper, but it appears to be driven by a traditional motor in an open-loop fashion. Though encoders were used, there is no indication they were used in realtime as a means of controlling the motor output. It appears that they were used only after the fact, to plot out positional data of various elements.

Martin Hirschkorn attempted to improve upon existing mathematical models of the grand piano action, and published a thesis in 2004 at University of Waterloo to this effect. His thesis was entitled "Dynamic Model of a Piano Action Mechanism". In it, he describes some experiments he performed, in an attempt to verify certain aspects of his derived model. For these experiments, a standard rotary motor was situated in front of the piano key. A 4-inch long aluminum arm was attached to the shaft, converting the small rotation into essentially linear downward motion at the top of the key. A "one key" action model from a grand piano was used. A small "button-type" load cell was adhered to the top of the key, for measuring reaction force. He first did several sample runs using an actual pianist, where the load cell measured the forces between finger and key. Some of the resulting force profiles were then used to painstakingly determine a current input profile for the motor which yielded similar reaction forces at the key. Of course, this was only applicable for that one particular action used in the experiments. The author was very interested in the resulting motion of various components of the action during excitation, so he positioned rotary encoders in three locations on the action, and also recorded other motions with high-speed video.

SUMMARY OF THE INVENTION

The invention defines new and improved parameters (Down Force, Up Force, Balance Force, and Average Friction) for evaluating important "stroke characteristics" of individual key actions of one or more pianos or keyboards, and describes exactly how these parameters are to be tested, measured and determined. The new parameters are designed to replace the prior art parameters of Down Weight, Up Weight, Balance Weight and Friction.

The invention further discloses various methods, means and apparatus for accurately testing, measuring and determining these new parameters, with the capability of performing thousands of measurements—on thousands of different key mechanisms—in a short amount of time.

These and other objectives and advantages of the invention will become more apparent from the following detailed description when taken in conjunction with the accompanying drawings.

Figure 1:
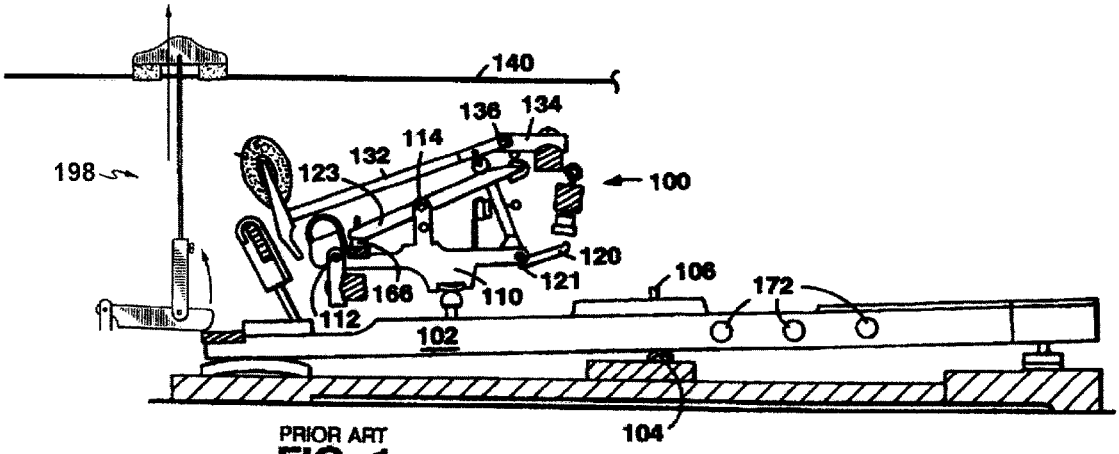
PRIOR ART FIG. 1
FIG. 1 is a side view of a typical prior art grand piano action, shown in its rest position.
Figure 1A:
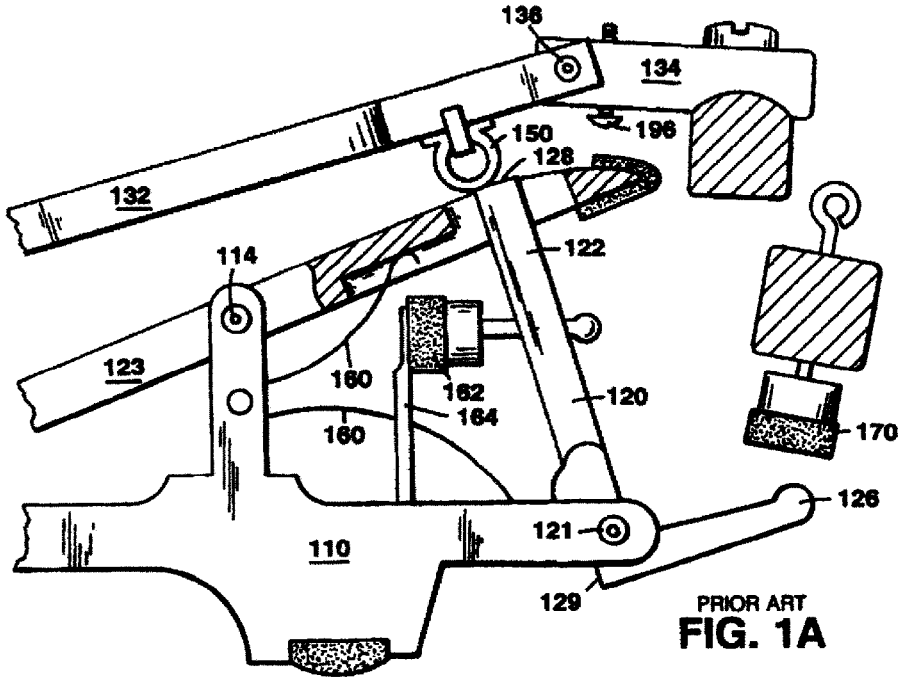
PRIOR ART FIG. 1A
FIG. 1A is an enlarged view of certain prior art grand piano action components shown in FIG. 1.
Figure 2:
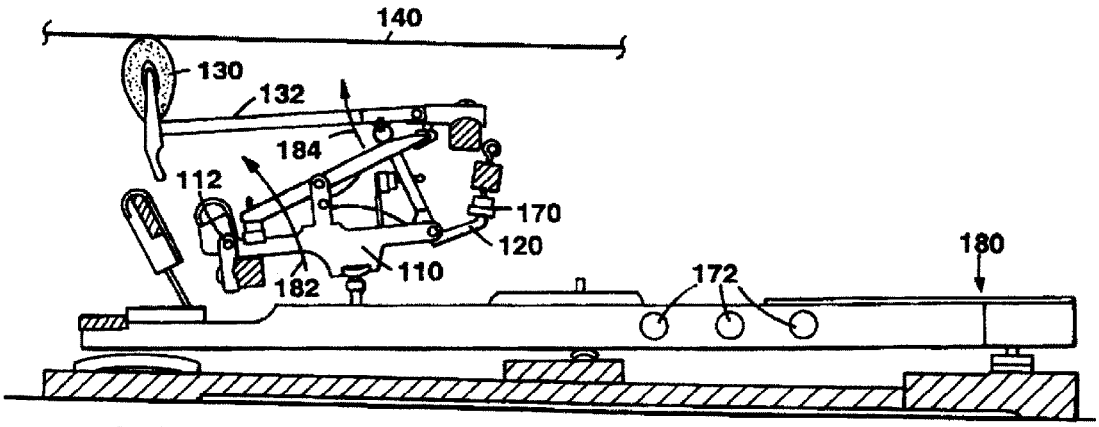
PRIOR ART FIG. 2
FIG. 2 is a side view of the same typical prior art grand piano action, but shown with a partially depressed key.
Figure 2A:
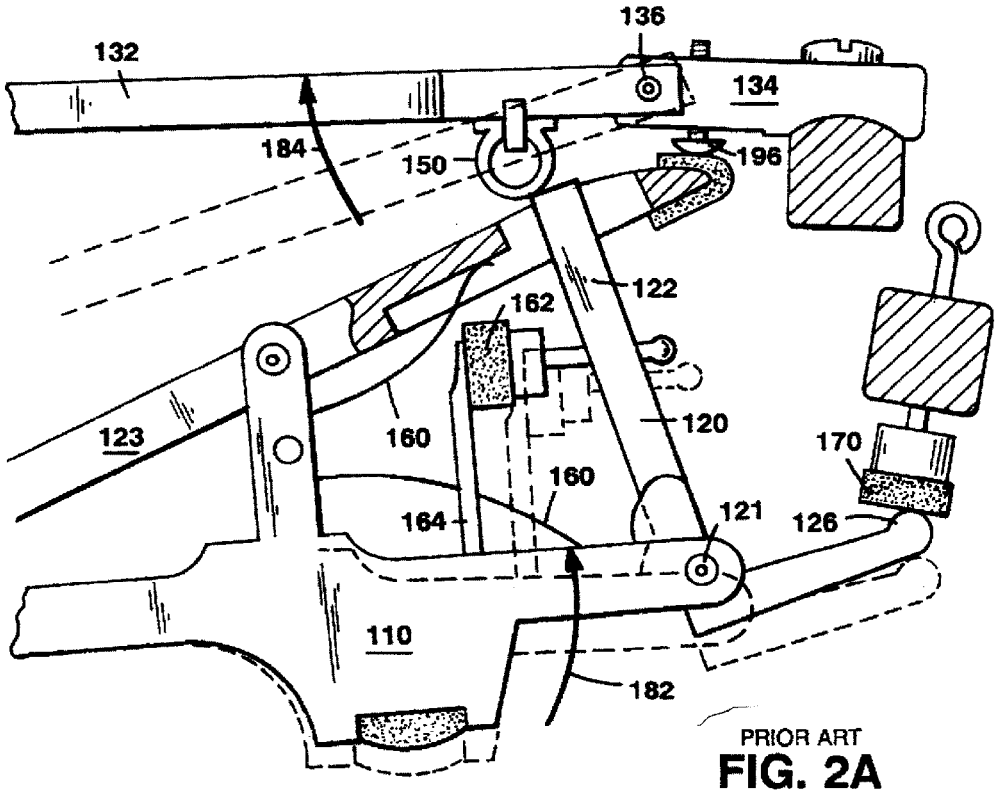
PRIOR ART FIG. 2A
FIG. 2A is an enlarged view of certain prior art grand piano action components shown in FIG. 2.
Figure 3:
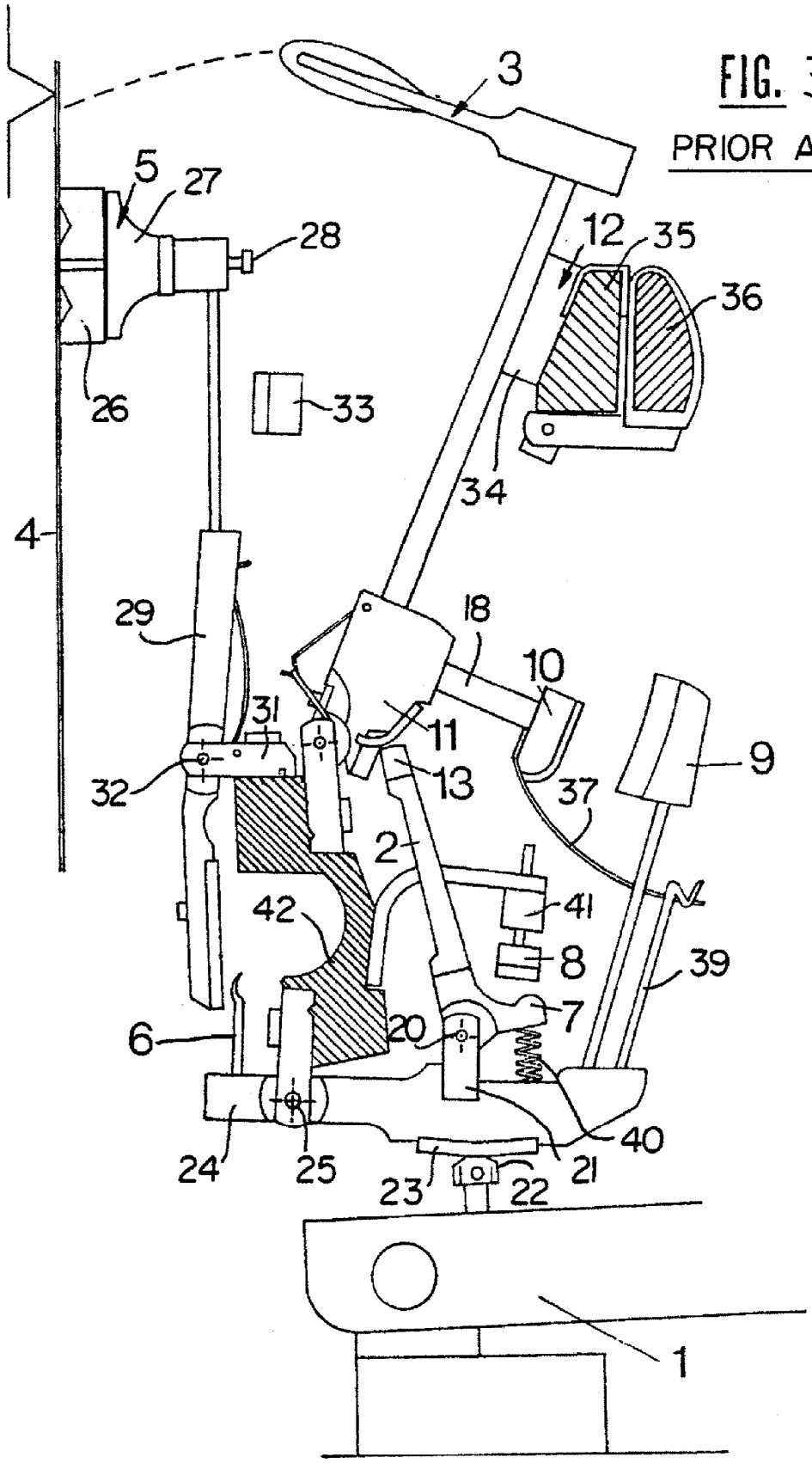
FIG. 3 PRIOR ART
FIG. 3 is a side view of a typical upright piano action, shown in its rest position.
Figure 4:
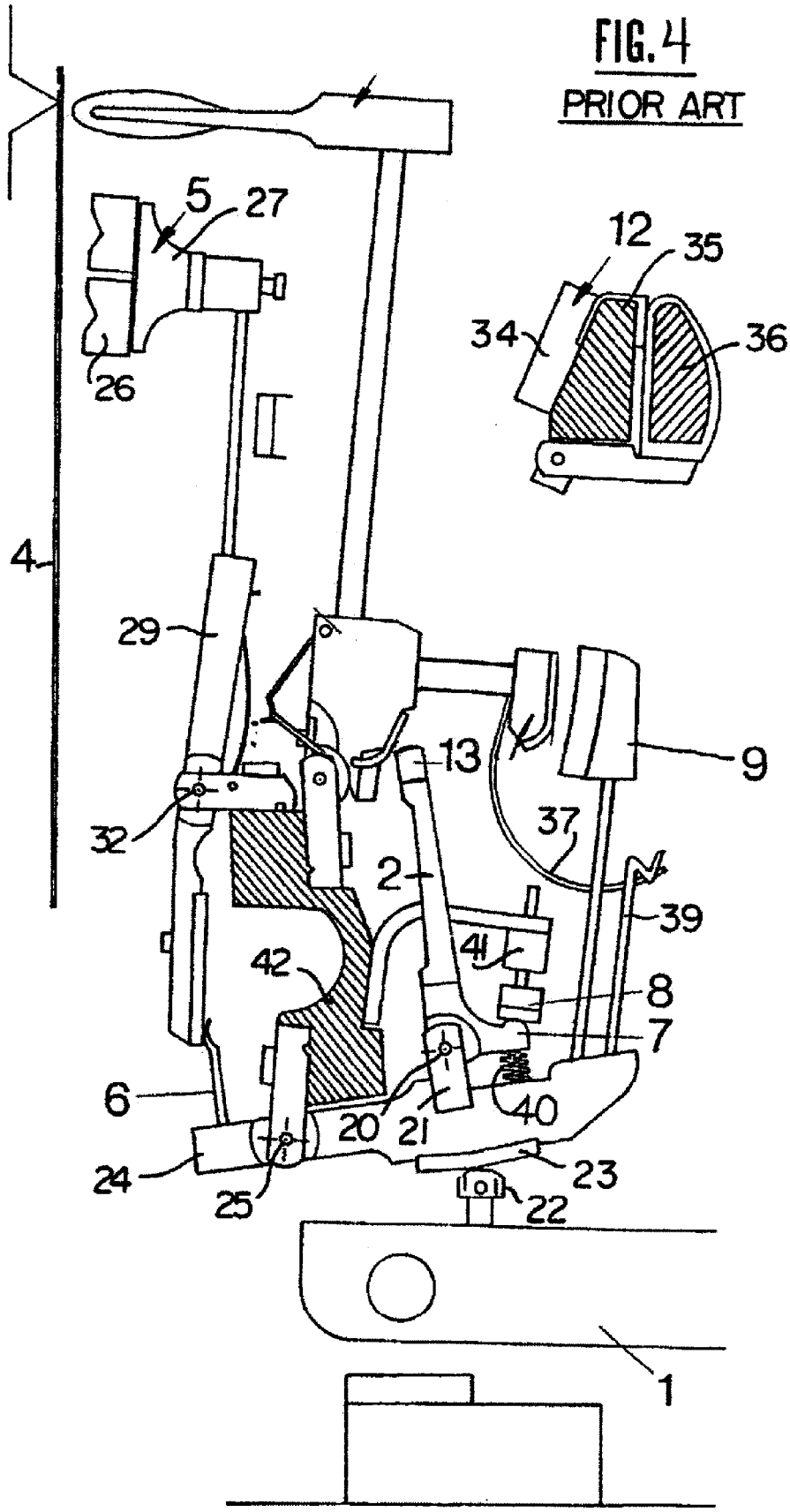
FIG. 4 PRIOR ART
FIG. 4 is a side view of same typical upright piano action, but shown with the front of key depressed.
Figure 5:
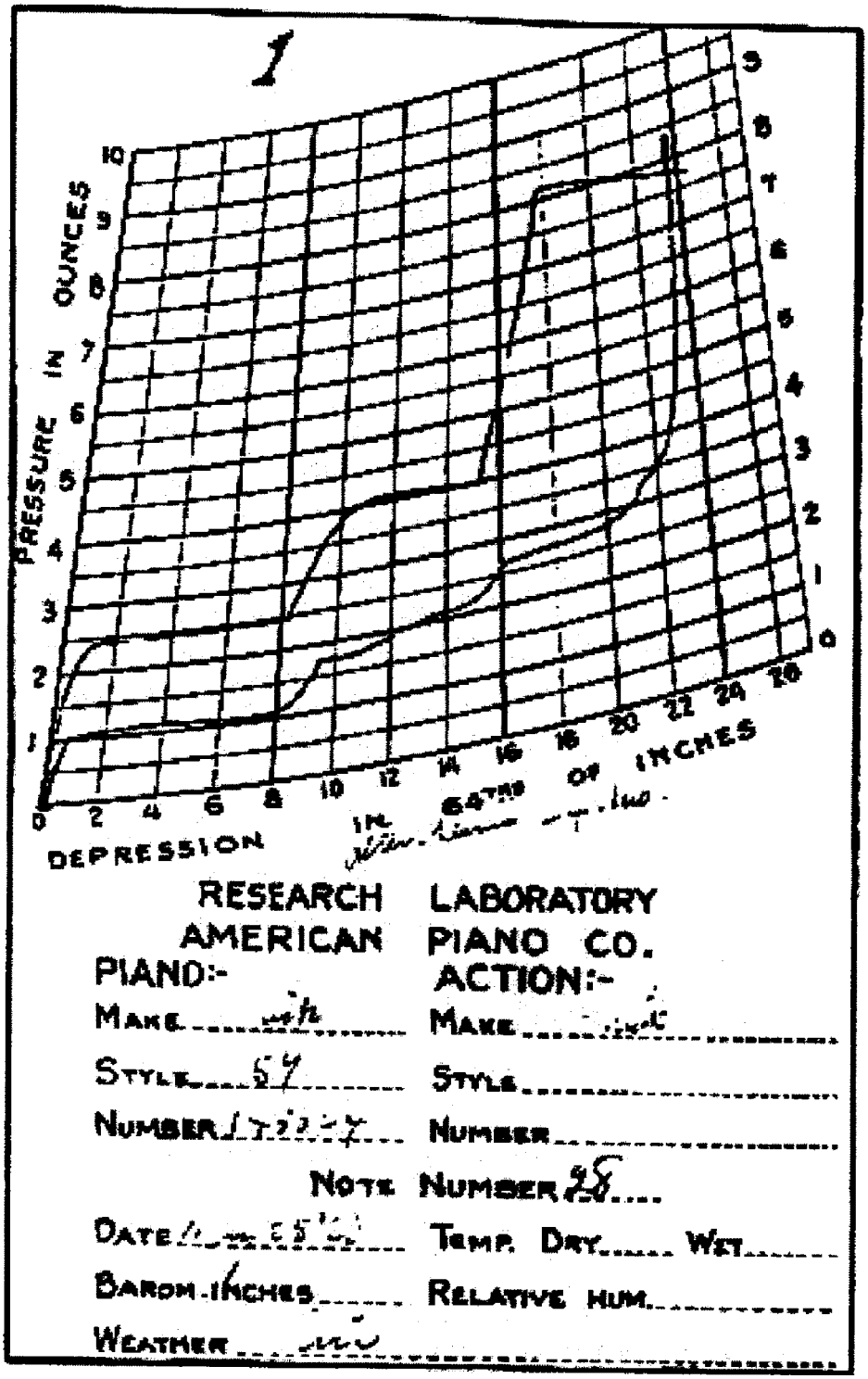
FIG. 5 shows a graph of piano key pressure vs. displacement, made in 1929 by Hickman

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION METHODS

FIGS. 1-4 and 6-9

A. Improved Method for Evaluating DW, UW, BW and Friction

The method proposed herein to overcome the inaccuracies inherent in the prior art parameters of DW, UW, BW and friction is to measure the resisting force continuously as the key is forced to descend in equilibrium (i.e., at constant speed). And also, to measure the contact force continuously as the key is allowed to ascend at constant speed back to its initial position. The damper lever would be fully disengaged for all these measurements. The method would then use the acquired force data to calculate an average contact force for the downstroke, and an average contact force for the upstroke. Downstroke, as used throughout this application, refers to any forced movement of the AP in a downward direction. Upstroke, throughout the application, refers to any movement of the AP in an upward direction. Rigorous formulations of the friction equation, using variations of Newton's $2^{nd}$ Law, will now be presented. This will allow still more weaknesses in the prior art methodology to become evident. Note that the resulting equation has the exact same form as the age-old friction equation. However, the various terms in the equation will be seen to be so different from their prior art counterparts, that new names will be given them. In order to explain the true formulation of the friction equation, a model will first be created that represents the actual piano key mechanism well.

Figure 6:
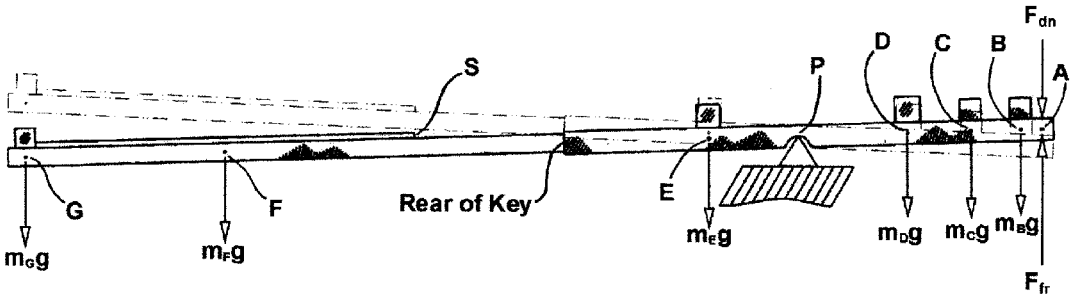
FIG. 6 is an idealized model of a piano key, showing force vectors for a downstroke.
Figure 7:
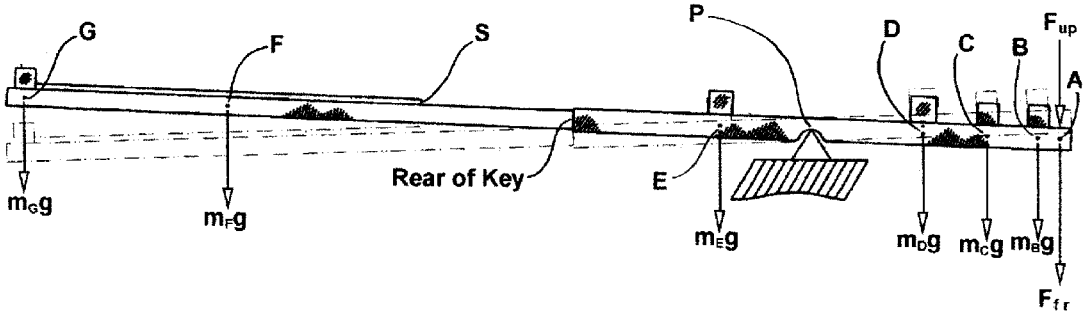
FIG. 7 is an idealized model of a piano key, showing force vectors for an upstroke.

As seen in FIGS. 1 through 4, a piano action is a "folded beam" arrangement. It can therefore be represented more simply as one continuous beam, pivoted at one fulcrum. Such a representation is shown in FIGS. 6 and 7. This arrangement has a front "key segment" that has the same mass and length as a typical piano key. Firmly attached to the rear of this key segment is a much longer segment, which is assumed to have infinite stiffness and zero mass. Its length is long enough so that the leverage created at its back end (left end in FIGS. 6 and 7) is similar to the leverage between the hammer head and the AP in a typical piano. Masses are placed at the centerline of the key segment at various points where keyleads might be typically found in a piano key. In FIGS. 6 and 7, these are points B, C, and D, with A being the Application Point (AP). Blocks representing each of these masses are shown sitting on top of the key only for illustrative purposes. The mass at each point is designated $m_B$, $m_C$, and $m_D$. Another mass, designated $m_E$, is located at point E, also on the centerline of the key. Its location represents the lever ratio of the center of mass of a typical wippen, relative to the AP. The term $m_E$ represents the entire mass of the wippen. The length of the key segment is designated $l_K$. The rear segment has the purpose in this model of locating the hammer head mass center and the hammer shank, thus ensuring they are leveraged correctly with respect to the AP. Stated another way, the rear segment positions the hammer and shank mass centers so that, when the entire beam model rotates, they are moving at the correct speed with respect to the AP (point A). In a typical piano, the hammer head is moving 5 or 6 times faster than the AP. In the model here, the hammer head mass is designated $m_G$, and is located at G, on the centerline of the rear segment (which coincides with the centerline of the key segment). For any given small displacement of point A, point G moves "x" times faster, where "x" equals the average Action Ratio of the actual piano action. Stated another way, point G moves "x" times faster than point A, where "x" is the Action Ratio of the piano action.

The effect of the hammer shank on the static force at the AP is rather small. For this reason, only half of the shank is represented in this model, the "outer" half—closest to the hammer head. The "inner" half, closest to the pivot, has little effect on the Balance Weight at the AP. In the model, the shank begins at S, and extends all the way to G, the hammer head mass location. Since it represents half of the length of the actual shank, the point S is halfway between P and G. Thus, point S has exactly half of the leverage that point G has. That is, it travels half as fast as point G, since point P is fixed. The mass of the "half-shank"—designated $m_F$—is chosen to be at point F, which is simply half way along the "half-shank". This position obviously corresponds to the center of mass of the half-shank. So one can see that in this model, the speed of F is exactly 75% of the hammer head speed (point G). This corresponds exactly to the real-world half-shank.

In the model, friction exists at the single pivot, and is of sufficient magnitude to exactly represent the combined effects of friction at the various pins and sliding joints in the true action being modeled. The equivalent effect of this frictional resistance—translated to point A—is denoted by an upward or downward force $F_{fr}$, acting at point A. $F_{fr}$ acts upwardly if the rotation of the model is CW, and downwardly if the rotation is CCW. The force applied at point A in moving point A downwardly is designated $F_{dn}$. The reaction force at A, as point A is allowed to move upwardly, is called $F_{up}$. All of these force vectors, including those due to the weight of all the separate masses in the model, are applied to the model in FIG. 6 for the case of a downward movement of A. FIG. 7 shows the applied forces when there is upward movement of A. Note that there is no mass representing the key itself in the model. This is due to its center of mass being so close to the pivot P. Any potential energy changes this point mass would undergo would be negligible. Similarly, in the subsequent method using the Impulse-Momentum theory, the impulse on the rotating system, due to the gravity force on the key's center of mass, would be negligible as well. Of course, as will be seen in both of the following methods, these potential energy terms, and gravity-generated impulse terms, cancel out of their corresponding equations anyway.

Method 1

Work-Energy Theorem—FIGS. 6 and 7

Part (a): Controlled Downstroke

As part (a) of the first method, point A is first accelerated by a force $F_{dn}$ to some constant downward speed, then maintains that constant tangential speed for some finite distance. During this movement, which is a controlled downstroke, the resulting value of $F_{dn}$ is continuously measured. Once point A achieves a constant speed, Newton's $2^{nd}$ Law can be easily applied to the motion to obtain one of the two necessary equations. The end result is an equation for Average Friction, AF. This rigorous formulation of the equation for AF will prove that the method I propose for measuring DW and UW (and therefore friction) is indeed the only method that stays true to all of the assumptions inherent in the formulation.

For part (a), the downstroke, the Work-Energy Theorem will be implemented. I will define "y" as the vertical displacement of point A, with positive direction directed downward. The theorem will be invoked between two points of this downward movement, once constant downward speed has been achieved. The initial point will have y=p, while the final point will have y=q, where q is greater than p. The Work-Energy Theorem states that the final kinetic energy (KE) of some system is equal to its initial KE plus the sum of all work done on the system by external forces between the initial and final states. So the equation starts out as:

$$KE)_p + W)_{ext} = KE)_q$$

Using the force vectors shown in FIG. 6, and noting that the vertical displacement at any of the given masses is called $h_i$, the above equation becomes:

$$KE)_p+\Sigma_{i=B\to D}m_i g\Delta h_i-\Sigma_{i=E\to G}m_i g\Delta h_i-\int_p^q F_{fr}dy+\int_p^q F_{dn}dy=KE)_q$$

Because I insisted that the speed of the system be already constant when this integration begins at y=p, and remain constant when y=q, one sees that the two kinetic energy terms are equal, and thus drop out of the equation. That leaves me with:

$$\Sigma_{i=B\to D}m_i g\Delta h_i-\Sigma_{i=E\to G}m_i g\Delta h_i-\int_p^q F_{fr}dy+\int_p^q F_{dn}dy=0 \quad \text{(Equ. 1)}$$

Part (b): Controlled Upstroke

The Work-Energy Theorem will also be implemented. Here, point A begins in a more downwardly position, and is allowed to accelerate upwardly to some constant upward speed, then maintains that constant tangential speed for some finite distance. Once this upward constant speed is attained, Newton's $2^{nd}$ Law can be easily applied to the motion to obtain the second of the two necessary equations. Note that for this movement, the positive direction for y will be considered UP. Also note that the final point of the downstroke movement, called "q" in part (a), will be the initial point of the upstroke movement, and will now be called "p". The final point for this upstroke will be called "q", and is the same point as "p" for the downstroke movement. And similar to part (a), assume that point A has already reached a constant speed by the time y=p in this upstroke. And assume that this speed stays constant all the way until y=q. The initial equation is the same as in part (a):

$$KE)_p+W)_{ext}=KE)_q$$

From FIG. 7, this becomes $$KE)_p-\Sigma_{i=B\to D}m_i g\Delta h_i+\Sigma_{i=E\to G}m_i g\Delta h_i-\int_p^q F_{fr}dy-\int_p^q F_{up}dy=KE)_q$$

As in part (a), my assumptions forced the initial and final KE's to be equal, so the equation becomes:

$$\Sigma_{i=E\Theta G}m_i g\Delta h_i-\Sigma_{i=B\to D}m_i g\Delta h_i-\int_P^q F_{fr}dy-\int_p^q F_{up}dy=0 \quad \text{(Equ. 2)}$$

Now by adding Equations 1 and 2 to each other, the potential energy terms drop out, and one is left with:

$$\int_p^q F_{dn}dy-\int_p^q F_{up}dy=2\int_p^q F_{fr}dy$$

Solving this for the friction integral, it becomes:

$$\int_p^q F_{fr}\,dy=\frac{\int_p^q F_{dn}\,dy-\int_p^q F_{up}\,dy}{2}$$

The above becomes, after dividing both sides by (q−p):

$$\frac{\int_p^q F_{fr}\,dy}{(q-p)}=\frac{\int_p^q F_{dn}\,dy-\int_p^q F_{up}\,dy}{2(q-p)} \quad \text{(Equ. 3)}$$

Since the average of any function of y, from y=p to y=q, is defined as the definite integral of that function from p to q, divided by (q−p), one sees that three separate averages appear in this equation. These three will be named as follows:

$$Avg.DownForce=DF=\frac{\int_p^q F_{dn}\,dy}{(q-p)} \quad \text{(Equ. 4-a)}$$

$$Avg.UpForce=UF=\frac{\int_p^q F_{up}\,dy}{(q-p)} \quad \text{(Equ. 4-b)}$$

$$Avg.Friction=AF=\frac{\int_p^q F_{fr}\,dy}{(q-p)} \quad \text{(Equ. 4-c)}$$

Given this new nomenclature, Equation (3) above becomes:

$$AF=\frac{(DF-UF)}{2} \quad \text{(Equ. 5)}$$

So, the Average Friction over a given range of key displacement is equal to half the difference of the Average Down Force and Average Up Force, over that same range. Note that it has the exact same form as the traditional friction equation, with friction, DW, and UW replaced by AF, DF, and UF.

Method 2

Angular Impulse-Momentum Theorem—FIGS. 6 and 7

If one wants to formulate the same governing equation, but in the time domain, rather than displacement, the preferred version of Newton's $2^{nd}$ Law to use would be the Impulse-Momentum equation, or similarly the Angular Impulse-Momentum equation. The latter states that the final momentum of the system must equal the initial momentum plus the summation of all angular impulses imparted to the system. Interestingly, one finds the exact same assumptions necessary in this formulation, as were found in the Work-Energy formulation. Namely, no acceleration or deceleration can occur along the range of calculation. Any such change in velocity would necessitate the addition of impulse terms representing inertia forces/moments. Furthermore, to ensure a fairly simple equation, the initial and final momentums must be the same.

Part (a): Controlled Downstroke

The downstroke is considered first, with the initial state defined as time "a", with point A relatively high, and the final state defined as time "b", where point A is relatively lower. Also, point A is already moving down at a constant speed when time "a" is reached. That is, the entire integration is done while point A is moving at a constant downward speed. Looking at FIG. 6 again, and using impulse-momentum, one has:

$$H_b-H_a=\int_a^b M dt$$

where $H_b$ and $H_a$ are the angular momentums at times b and a of all the particles, and M is the total moment about P due to the external forces on the system, at any given time t. So the integral of M from time "a" to time "b" is therefore the integral of each of these separate external moments, about P, between time "a" and time "b". Calling the velocity of a given mass "i" in FIG. 6 "$v_i$", and calling the position vector from P to each point as "$r_i$", the equation becomes:

$$\sum_{i=B}^{G}(r_i \times m_i v_i)\Big|_{t=b} - \sum_{i=B}^{G}(r_i \times m_i v_i)\Big|_{t=a} = \sum_{i=B}^{G}\int_a^b (r_i \times m_i g)\,dt + \int_a^b (r_A \times F_{dn})\,dt + \int_a^b (r_A \times F_{fr})\,dt$$

Since the initial and final speeds were forced to be identical, the LHS of this equation becomes zero, leaving:

$$0 = \sum_{i=B}^{G}\int_a^b (r_i \times m_i g)\,dt + \int_a^b (r_A \times F_{dn})\,dt + \int_a^b (r_A \times F_{fr})\,dt \quad \text{(Equ. 6)}$$

Part (b): Controlled Upstroke

Now the same equation is used on the upstroke, integrating from another time "a" to another time "b", and ensuring that (b−a) in the upstroke equals (b−a) in the downstroke. In addition, the location in the downstroke corresponding to the downstroke's time "b" is the same exact location corresponding to the upstroke's time "a". And of course, the location in the downstroke corresponding to the downstroke's time "a" is the same exact location corresponding to the upstroke's time "b". And as before, point A is already moving up at a constant speed when time "a" is reached. That is, the entire integration is done while point A is moving at a constant upward speed. Referring again to FIG. 7, the equation is seen to be:

$$\sum_{i=B}^{G}(r_i \times m_i v_i)\Big|_{t=b} - \sum_{i=B}^{G}(r_i \times m_i v_i)\Big|_{t=a} = \sum_{i=B}^{G}\int_a^b (r_i \times m_i g)\,dt + \int_a^b (r_A \times F_{up})\,dt + \int_a^b (r_A \times F_{fr})\,dt$$

Since the initial and final momentums of all point masses are identical, the lefthand side of this equation becomes zero, leaving:

$$0 = \sum_{i=B}^{G}\int_a^b (r_i \times m_i g)\,dt + \int_a^b (r_A \times F_{up})\,dt + \int_a^b (r_A \times F_{fr})\,dt \quad \text{(Equ. 7)}$$

Now Equ. (7) is subtracted from Equ. (6). All of the gravity-based angular impulse terms drop out, leaving:

$$0=\int_a^b (r_A \times F_{dn})dt - \int_a^b (r_A \times F_{up})dt + \int_a^b (r_A \times F_{fr})dt\Big|_{dn} - \int_a^b (r_A \times F_{fr})dt\Big|_{up}$$

Notice the "dn" and "up" tacked onto the two friction terms, to remind us that one is for the upstroke, and one for the downstroke (the directions of the force vector are opposite). Performing the cross products, and looking closely at the directions of the vectors in FIGS. 6 and 7, results in:

$$0=\int_a^b (\sin 270° \cdot r_A \cdot F_{dn})dt - \int_a^b (\sin 270° \cdot r_A \cdot F_{up})dt + \int_a^b (\sin 90° \cdot r_A \cdot F_{fr})dt\Big|_{dn} - \int_a^b (\sin 270° \cdot r_A \cdot F_{fr})dt\Big|_{up}$$

Bringing all the constant terms out in front of the integrals, and evaluating the sine terms, gives:

$$\int_a^b F_{dn}dt - \int_a^b F_{up}dt = 2\int_a^b F_{fr}dt$$

Dividing through by (b−a) gives:

$$\frac{\int_a^b F_{dn}\,dt}{(b-a)} - \frac{\int_a^b F_{up}\,dt}{(b-a)} = \frac{2\int_a^b F_{fr}\,dt}{(b-a)} \quad \text{(Equ. 8)}$$

As mentioned before, the definite integral of any continuous function from a to b, divided by (b−a), is the very definition of the average of that function over that interval. These three "average" equations are:

$$Avg.of\ 'F_{dn} = \frac{\int_a^b F_{dn}\,dt}{(b-a)} \quad \text{(Equ. 9-a)}$$

$$Avg.of\ 'F_{up} = \frac{\int_a^b F_{up}\,dt}{(b-a)} \quad \text{(Equ. 9-b)}$$

$$Avg.of\ 'F_{fr} = \frac{\int_a^b F_{fr}\,dt}{(b-a)} \quad \text{(Equ. 9-c)}$$

So, by implementing a different form of Newton's $2^{nd}$ Law, which keeps things in the time domain, I have revealed three different equations—in terms of "t", rather than "y"—for the Average Down Force, Average Up Force, and Average Friction. As long as the time range (from a to b) corresponds exactly to the displacement range (p to q) in the corresponding equations of Method 1, then the resulting averages must be identical. Since they are identical, I can use the same terms I introduced earlier to describe them, namely: DF for the average of $F_{dn}$, UF for the average of $F_{up}$, and AF for the average of $F_{fr}$. Putting these three terms into Equ. 8 above, and dividing by 2, gives the result for average friction:

$$AF = \frac{(DF - UF)}{2}$$

This is exactly the same equation that was derived in Method 1 with the Work-Energy method.

In essence, the rigorous formulations given here, using Newton's $2^{nd}$ Law in two of its variations, shed light on the important assumptions that are inherent in the final equation for friction, and also in the equations defining DF and UF. The prior art friction equation has been used for many years, with little thought seemingly given to its origin or inherent assumptions. I have made it clear that certain conditions must be met if a good answer is to be the result. And also I have made it clear that the continuous functions of $F_{dn}$ and $F_{up}$ must be known, and then integrated, over the range of interest. Simply placing a mass on the key and watching it descend gives little indication of the actual reaction forces occurring as the key descends. The changes in resistance along the descent cause corresponding changes in velocity of the key. Similarly, as the key ascends after sufficient gram weights have been removed, as in the prior art, little is known about the actual reaction force between the weights and the keytop. The changes in resistance as the key ascends cause corresponding changes in velocity of the key. So, not only are the $F_{dn}$ and $F_{up}$ functions not known throughout the range, but the important requirement of constant speed is often violated. I have also demonstrated that the Prior Art parameters of DW and UW are also flawed in expressing what they were apparently intended to express: the average reaction force as the key descends slowly or ascends slowly. The most obvious reason for this is the speed of descent or ascent can never be assured to be constant in the Prior Art. If it's not constant, then one simply does not know these reaction forces over the entire stroke, because acceleration terms appear in the governing equations. For all these reasons and more, the embodiments herein provide a much-improved method of measuring "Down Weight" and "Up Weight", and therefore indirectly friction.

Similar to how BW in the Prior Art is calculated from the simple average of DW and UW, the improved parameter Balance Force (BF) is calculated as the average of DF and UF, as follows:

$$BF = \frac{(DF + UF)}{2} \quad \text{(Equ. 10)}$$

This represents the combined effect of all non-inertial forces except friction, at the AP. And since it has been demonstrated above that the DF and UF parameters are superior to the DW and UW of the prior art, it will also be true that the new BF parameter is superior to the BW parameter of the prior art. Note also that, because both DF and UF are true averages over the range of interest, it follows from the above equation that BF is also a true average of some theoretical "balance force function" over the range of interest. Just as with their Prior Art counterparts, the region of interest for these new DF and UF measurement should be a portion of the key's stroke prior to so-called "let-off". This is because let-off brings kinematic discontinuities and extra, unrelated factors into the picture. The friction before let-off has mainly to do with pivot joints and fairly small relative, sliding motion occurring at the capstan and at the knuckle (or butt, if an upright piano). These sources of friction are essentially identical no matter which way the key is traveling—up or down. During let-off, additional friction occurs, much of it only existing on the downward movement of the key. This was expressed graphically in FIGS. 2 and 4. As I just demonstrated in the two derivations, the equations used to calculate friction in this manner demand that it be the same in both directions, thus ruling out passage into the let-off region.

So for the region of interest (before let-off), the replacement for "Down Weight", which I have coined Down Force (DF), accurately represents the average force required to depress the key a certain distance, at a constant speed. Similarly, the replacement for "Up Weight", which I have coined Up Force (UF), accurately expresses the average force acting upwards at the Application Point (AP) while the key is allowed to ascend, with the AP at constant speed, back to its original location. Today, each of the Prior Art values (DW and UW) do not represent a reaction force averaged over all or part of the stroke at all. Rather, they each represent the true reaction force at perhaps only one point—often the top, rest position for DW and somewhere near let-off for UW. DW as measured today typically represents the amount of force required to get the key moving slowly. If the resistance changes after 1 or 2 mm, either from lever arms changing, spring or magnetic forces changing, or friction itself changing, the current method has a good chance of overlooking it. The same logic applies to the current practice of measuring UW, as described before.

Demonstration of New Parameters being Calculated from Actual Measurements

Figure 8:
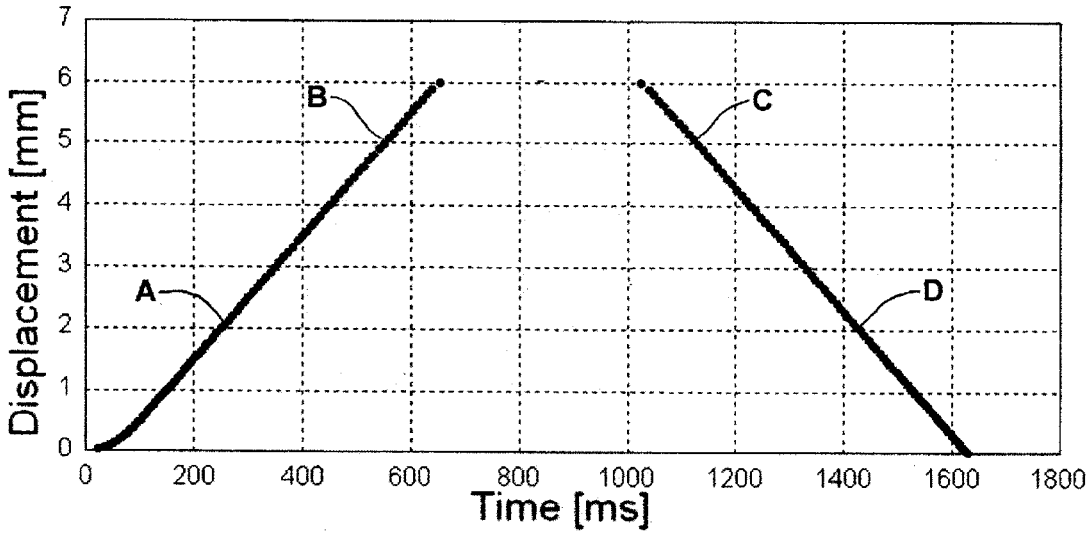
FIG. 8 shows the displacement vs. time profile used during run on actual piano action
Figure 9:
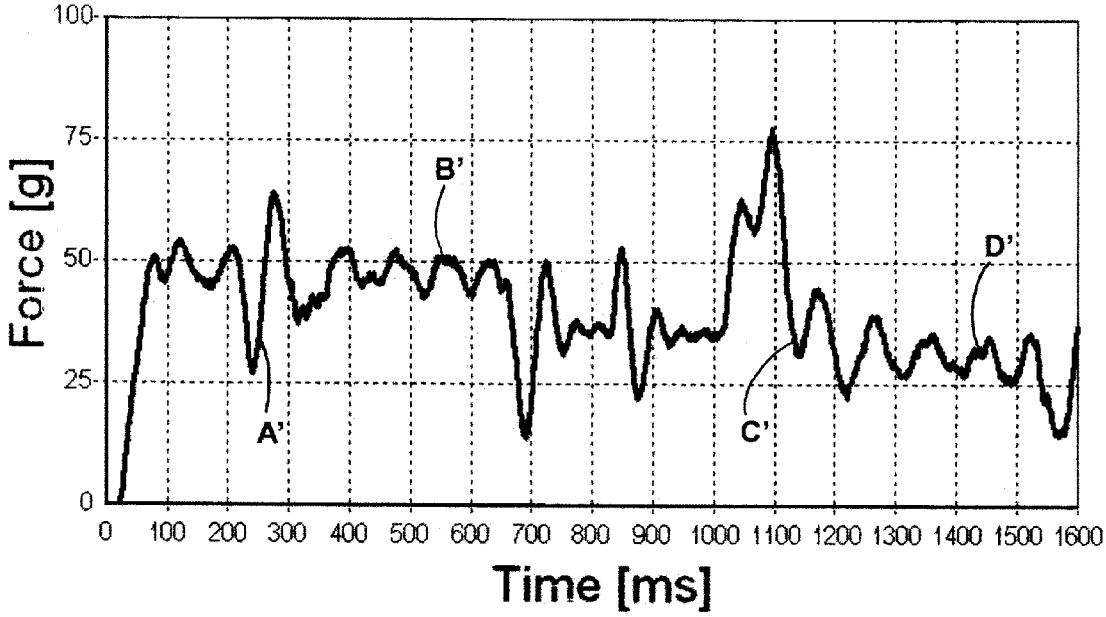
FIG. 9 shows the resulting reaction force vs. time curve generated when actual piano action was driven by the profile of FIG. 8

FIGS. 8 and 9

An example of the new methods being implemented on an actual piano key action now follows. FIGS. 8 and 9 describe both the motion of the key and the resulting contact forces measured. FIG. 8 shows the exact profile (displacement vs. time) the contact followed in moving the key down and then back up. The reaction force was measured, via a force transducer connected to the contact, continuously. The damper lever was disengaged fully. The resulting calibrated force data was sampled every 1 ms with an A/D converter (data acquisition device). In FIG. 8, positive displacement "y" is in the downward direction on the piano key, and y=0 corresponds to the top, rest position of the key. The contact initially follows a constant-acceleration curve ($y=0.00005\ t^2$, where y is in [mm] and t is in [ms]). Once t=100 ms, the contact maintains a constant speed, following the curve y=0.01 t-0.5. Point A, where the integration/averaging process for DF begins, is when y=2 and t=250. This constant speed is maintained until well after point B—where the integration ends—is reached. At point B, t=550 and y=5. At approximately y=6 mm, the motor stops the contact, and reverses its direction, waiting for a subsequent upstroke. The resulting reaction forces between the contact and the moving key, for the downward and upward movement just described, are shown in FIG. 9. Time is on the horizontal axis, with Force along the vertical axis. In FIG. 9, the same two points A (t=250 ms) and B (t=550 ms) in FIG. 8 are indicated as A' and B' respectively. Since the force is already graphed vs. time, I used Equ. (9-a) to calculate DF (as opposed to Equ. (4-a), based on displacement), with a=250 ms and b=550 ms. The resulting DF—the average Down Force between y=2 and y=5 mm—was found to be 47.7 grams.

Going back to FIG. 8, the contact "rested" briefly, once it reached the y=6 mm point. It then began to move upward at about t=1020 ms. At that point, it immediately began to follow the constant-speed equation of y=−0.01 t+16.3. With this equation being followed, the contact is at the y=5 mm point when t=1130 ms. This is labeled as point C in FIG. 8. The contact then reaches the y=2 mm point when t=1430 ms. This is labeled as point D in FIG. 8. Point C is where the integration begins for the upstroke, while point D is where it ends. So, as discussed in the derivation of the friction equation, the end of the downstroke integration should also be the beginning of the upstroke integration. In FIG. 9, the same two points C (t=1130 ms) and D (t=1430 ms) in FIG. 8 are indicated as C' and D' respectively. Using Equ. (9-b) to calculate the UF, with a=1130 ms, and b=1430 ms, results in an average Up Force (UF) of 30.5 grams. The average friction, AF, is thus found from Equ. (4) to be (47.7-30.5)/2, which is 8.6 grams. This is a fairly typical value for a piano key action. And of course, the BF is found from Equ. (10) to be (47.7+30.5)/2, which is 39.1 grams.

One can imagine the above "down and up" constant-velocity procedure being performed for any subregion of the stroke, as long as it avoids the let-off area, and as long as the contact is moving at constant speed throughout the subregion, in each direction. Thus you can obtain an average value of DF, UF, and therefore BF and AF, for the key between 1 and 3 mm, or between 4 and 6 mm, etc. The only concern is to make sure that the "lowest" point of the integration (i.e., largest "y") is not within the start of let-off. In this way, it is now possible to determine if the friction significantly changes along the stroke. If the AF arrived at by integrating between y=1 and y=3 is called $AF_{1-3}$, and the AF resulting from integration between y=4 and y=6 is called $AF_{4-6}$, then the two values can be compared. If $AF_{1-3}$ is significantly less than $AF_{4-6}$, then it can be assumed that the friction near the top of the stroke is less than the friction closer to the bottom. If the reverse were true, then one knows that the friction at the top of the stroke is greater.

The force data of FIG. 9 makes it clear that vibrations are typically occurring in the key action during these movements. This is likely due to resonance of the entire key action/contact system. In particular, if the contact is driven by "stepping" devices, such as a stepper motor, vibrations from that could be induced, particularly at certain pulsing frequencies. The reason for me having a constant-acceleration region at the beginning of the downstroke is to reduce these induced vibrations, so that the constant-speed region is optimized in terms of the quality of the readings, and relatively free from the worst vibrations. One can see from the specific example of FIG. 9 that these initial large disturbances die down significantly by the time t=315 ms. They remain fairly small throughout the downstroke region where the integration/calculation of DF takes place. The reversal of the contact, from downward to upward direction, induces some vibration, but this is of no consequence. When the contact finally begins its upward constant-speed stroke, at approximately t=1000, large vibrations are induced. But by the time point C is reached—the beginning of the integration/calculation of UF—they have died down considerably. As part of the embodiments of the method, one can use some experience and judgment in choosing the region of the stroke for averaging, to ensure that the force variations (vibrations) are within an acceptable level. One can also perform this routine at more than one set of speeds. Experiments have shown that for each direction, certain speeds result in less vibration than others. One can even calculate a standard deviation over different regions of the stroke, using their values to determine or change the integration/averaging region, thus ensuring it is void of the largest variations. Similarly, one can calculate a standard deviation over some region for runs performed at different speeds, and choose the best answer for DF and UF based on which run/speed yields the lowest variance or deviation.

It should be noted that the integrations mentioned above, in calculating DF and UF, can be done in any convenient manner. The easiest method, particularly when a computer is involved, is probably to numerically integrate. This method is very easily implemented into readily available computer programming routines, and is the method the present author has chosen to use. Another possibility would be to approximate the entire force vs. time (or force vs. displacement) curve with some best-fit function. This function could be of many forms, including a higher order polynomial. The resulting equation can then be integrated using standard formulas and rules from the calculus. It may be very difficult to get the equation of an approximating function that fits the data nicely, however.

B. Improved Method of Measuring Key Dip

Recall from above that the Key Dip of a key cannot be measured in the prior art, but merely compared to nearby keys, or to some standard, such as a key dip block or Jaras tool. An embodiment of the invention is therefore to allow the Key Dip of any key action to be measured directly. The Key Dip values of all keys on a piano, for instance, can then be plotted and quickly compared to each other. The method is now described. Assuming a means for moving the key action downward, at the AP, in an accurate and controlled manner is available, along with a means for simultaneously measuring the reaction force between the contact and the key top, at the AP, then the following method can be used to determine the stroke, or key dip, of the key action. With the sustain pedal depressed, or damper lever otherwise disengaged, a contact or probe would move the key, at the AP, downwardly at a fairly slow, and nearly constant speed. The contact would continue moving downward until it sensed a sufficiently-prolonged increased resistance, at or above a threshold of force greater than what would be required for achieving let-off and tripping of the jack. This threshold of force should furthermore be small enough not to waste any undue motion compressing the felt, at the front rail between the key and keybed. Once this prolonged increase in reaction force is achieved, the motion of the contact would stop, and its displacement, relative to the "at-rest" position of the key and contact, would be recorded. The value to be used for the force threshold should be at least 250 grams, based on my experiments. As this "keydip evaluation" process occurs, the software control program or routine, as the contact descends against the key, would repeatedly ask the questions:

a) is the Threshold Force exceeded, and b) has it been exceeded long enough to ensure that the force is indeed related to bottoming out, rather than spikes related to some sort of electrical noise or temporary resistance (such as let-off).

Figure 23:
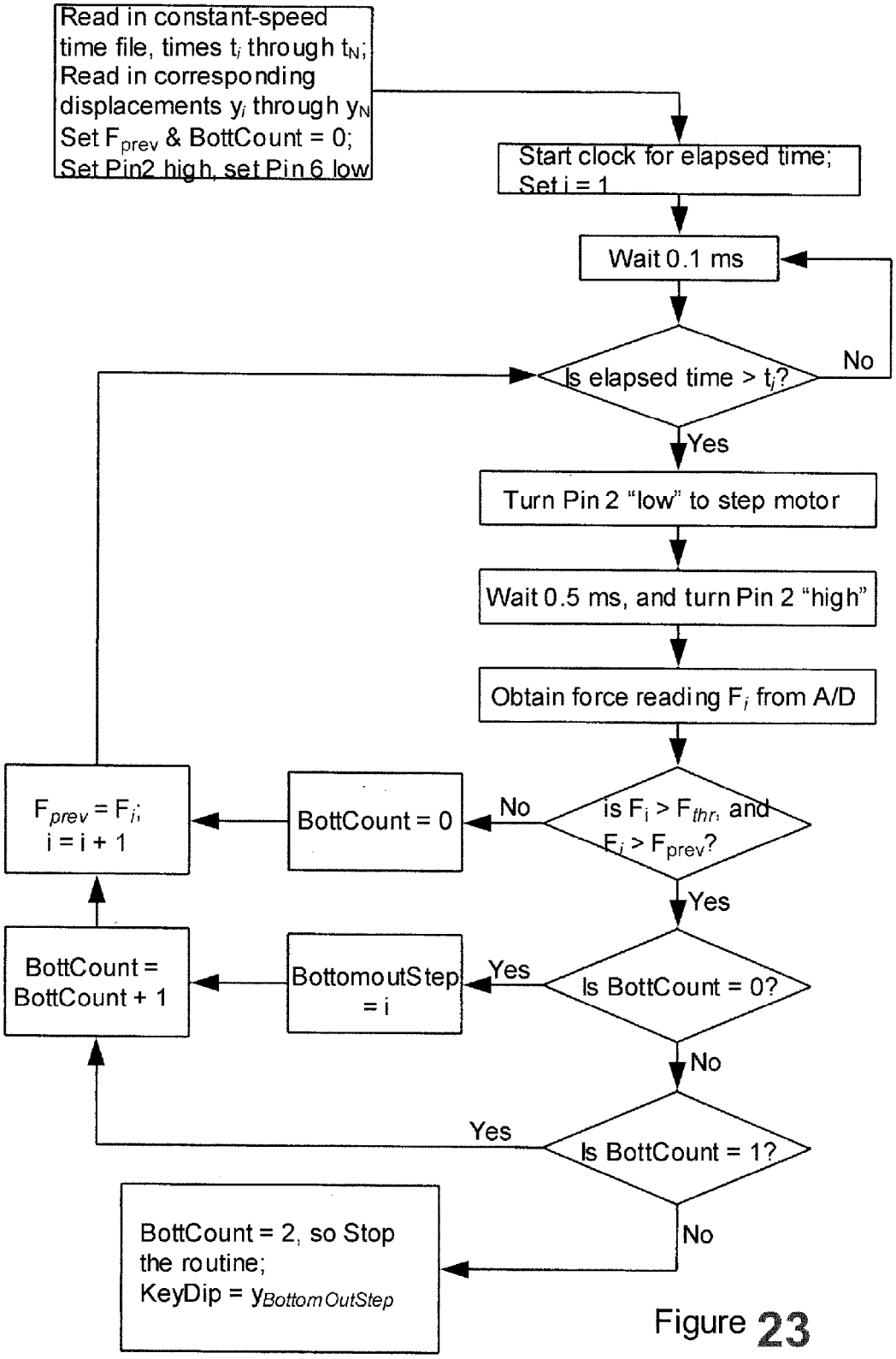
FIG. 23 is a flowchart showing a key-dip run process according to the invention.

If the answer to both (a) and (b) is yes, then the net displacement of the AP, at which the threshold force began to be surpassed, is recorded. This value, as measured or confirmed today via current practice means, is known as that key action's "Key Dip". It usually falls between 9 mm and 10.5 mm for most pianos. Recall that since the AP is following a well-defined displacement versus time, once the time is determined as described in the embodiment, the corresponding displacement is calculated from that relationship. An example of how this key dip measurement process can be implemented, using an actual apparatus, is shown in FIG. 23.

Apparatus

FIGS. 10-25

Several embodiments described herein relate to a machine for measuring piano action properties by exciting a piano key 73 while simultaneously measuring the resulting reaction forces on the key. One of the main obstacles to be overcome in being able to do this quickly and repeatedly on one key, or many different keys, has to do with addressing the key. That is, before a given run can be made, the contact or probe must know its exact vertical location, with respect to the top of the key being measured. All embodiments of the invention have a motor (61, 61*a*), a force transducer 67 and a contact 68, the latter corresponding to the exciter or probe. The contact is the portion of the machine that actually touches and moves the piano key, and also transmits the reaction force to the force transducer. The controlled movement and positioning of the contact near or against the key, not including preparatory movements such as Home Address and Key Address discussed below, while simultaneously measuring and recording any reaction forces acting between the contact and the key, is hereinafter referred to as a Run. There can be several runs on one key, each with potentially different movements (constant speed, constant acceleration, downward, downward and upward, etc.), and each designed to extract different information. In all the included embodiments describing a machine, in preparing for the next run, the motor is first brought to its "home position".

Home position is herein defined to be any one point in the motor's movement that corresponds to some convenient and predetermined vertical position of the contact, relative to the machine itself. So in referring to "home position", one can be referring to either the motor position or the contact position. In one embodiment, this is the topmost point in the contact's travel. The process of bringing the motor and contact to home position will hereinafter be referred to as Home Address. The Home Address process can purposefully or accidentally result in the contact being either:

(A) well clear of (i.e., above) the top of the key, or (B) displacing the current key downward by a significant amount.

These two types of Home Address will hereinafter be referred to as Home Address (A) and Home Address (B), respectively. Regardless, Home Address only puts the contact 68 in a known location relative to the machine. Before an actual run is begun, the contact must be exactly located relative to the piano key 73 which is to be the subject of the run. If this doesn't happen, then none of the resulting force data can be accurately known as a function of key displacement. This process of positioning the contact correctly relative to the key will be hereinafter referred to as Key Address. Thus, after the completion of any previous run, or at the start of a series of measurements, the machine first undergoes Home Address, followed by Key Address. Key Address consists of finding the top of the key at its rest position, and stopping the contact at that point, but may also include further positioning of the contact with respect to the key.

If Home Address (A) has just occurred, then the embodiments accomplish key address (the downwardly-moving Key Address process) by:

(1a) moving the contact 68 downwardly (substantially vertical) in a deliberate manner, while simultaneously trying to determine the point where the contact just begins to touch the top of the key 73, and (2a) stopping the downward movement when it is determined that the contact has started contacting the key, and (3) [optional] actuating the motor so that the contact moves upward by some predetermined amount, relative to the key.

In steps (1a) and (2a), the method for determining initial contact with the key 73 can vary. The force transducer 67 itself can perform this function. In step (2a), when the contact 68 begins to contact the key, the force sensed by the force transducer will increase sharply, as will its output voltage. This could be easily seen by the user on a Data Display Means. Alternatively, some sort of contact sensor or proximity sensor can be used. A proximity sensor could be built into the contact itself, or could exist nearby the contact 68. It could be of any standard type. These might include capacitive, inductive, infrared, laser-focusing. As long as the design and output of the sensor allows the controlling program (the software operating as specified herein, such as on computer 93 or other cpu-based computing device, discussed below) or user to know exactly where the top of the key is, relative to the contact, it could be used. If a capacitive sensor were used, it could be embedded into the contact itself for example. The sensor head may be situated above the actual contact point by some distance. Calibration could first be done to determine what the sensor's output voltage is when a typical piano key is brought fully into contact with the contact 68. In operation, the output of the sensor could then be connected to another channel of the A/D converter 90. The resulting voltage could easily be displayed on a Data Display Means. So during Key Address, one would then know exactly what voltage value on that channel corresponds to a typical key beginning to touch the contact 68.

The optional step (3) could be useful in certain types of runs. For instance, if one desired a run where the contact needs to be moving at constant speed even early in a downward stroke, then this extra step would be implemented in the Key Address. One could utilize this additional step to accurately position the contact 1 or 2 mm above the key, giving the motor and contact 68 a chance to gently accelerate to a constant speed before contact with the key is made.

If Home Address (B) has occurred, then the embodiments accomplish key address (the upwardly-moving Key Address process) by:

(1b) moving the contact 68 upwardly (substantially vertical) in a deliberate manner, while simultaneously trying to determine the point where the contact just begins to end contact with the top of the key 73, and (2b) stopping the upward movement when it is determined that the contact has begun to separate from the key, and (3) [optional] actuating the motor so that the contact moves further upward by some predetermined amount, relative to the key.

As mentioned above, in the description of the downwardly-moving Key Address process, the force transducer itself can be used to determine the "separation point" in step (2b). As soon as the contact 68 begins to separate from the key 73, the voltage output from the force transducer 67 will reduce to a point near zero. This change in voltage could easily be sensed by the controlling program, or seen on a Data Display Means by the user. And as mentioned above, a proximity sensor could also be used for this purpose. If a capacitive sensor were embedded into the contact itself, for example, then it would output a certain voltage while in direct contact with the key. Once the contact left the key, this voltage would change significantly. This voltage change would be easily detected by the controlling program, or seen on a Data Display Means. Any device, arrangement or means—including the force transducer 67 or the proximity sensor—that generates a signal, or changes its output signal, when the contact 68 either begins touching or begins separating from the key 73, is defined herein as the Key-Rest-Detection Means. In general, Key-Rest-Detection Means is a means for providing a signal indicative of the relative position between the contact 68 and an at-rest key 73. In the embodiments described herein, Key-Rest-Detection Means is a means for providing a signal indicative of a change in contact condition (such as contact initiation or break from contact) between the contact 68 and a key 73. Key-Rest-Detection Means may also be means for providing a signal indicative of some predetermined offset clearance between the contact 68 and an at-rest key 73.

The output signal from the Key-Rest-Detection Means, upon completion of Home Address, may also be used to indicate whether it was Home Address (A) or Home Address (B) that occurred. This could vary from key to key, with very low keys resulting in a Home Address (A) (i.e., the contact 68 being well clear of the key top), and very high keys resulting in Home Address (B), where the contact 68 is displacing the key downward. In the Home Address (A) case, the output from force transducer would be around zero volts, assuming that the bridge was balanced and stable. A capacitive proximity sensor, if utilized, would then register a voltage quite different from its known "direct contact" value. In the Home Address (B) case, the output voltage from the force transducer 67 would be some significant value, since a significant force is now acting on the contact. Similarly, if a capacitive proximity sensor were being used as the Key-Rest-Detection Means, the sensor voltage would then correspond to the known "direct contact" value, obtained from previous calibrations on typical piano keys.

The means used to move the contact 68 substantially vertically per steps (1a) and (1b) of Key Address is hereinafter known as the Contact-Adjusting Means. It can take on various forms, as will be seen below in some of the embodiment descriptions.

Figure 10:
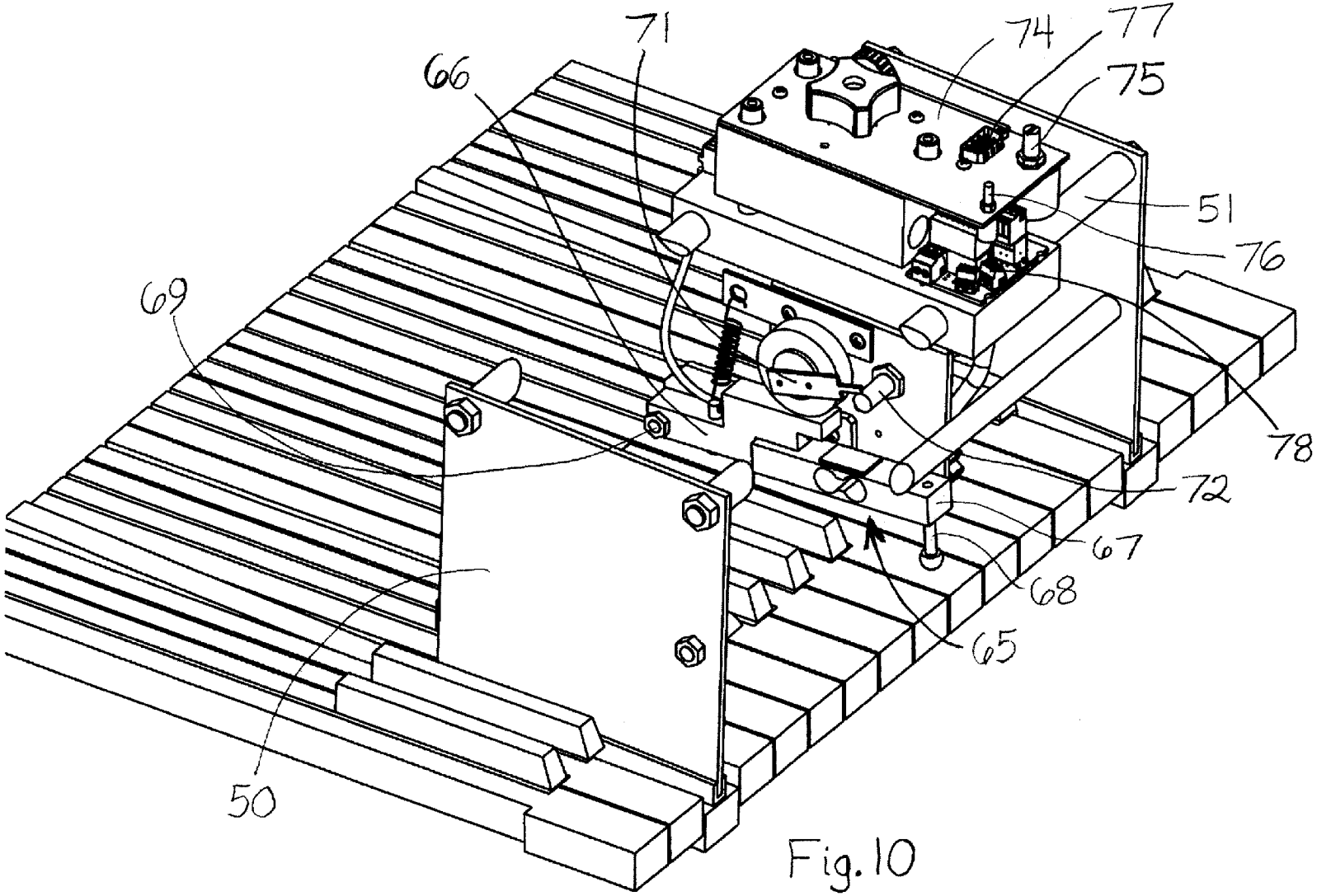
FIG. 10 is a fragmentary perspective view of one embodiment of a device configured for use with and in accordance with certain aspects of the invention, the device being shown as on a keyboard for practicing certain methods of the invention, with certain parts of the device being broken away and not shown.
Figure 11:
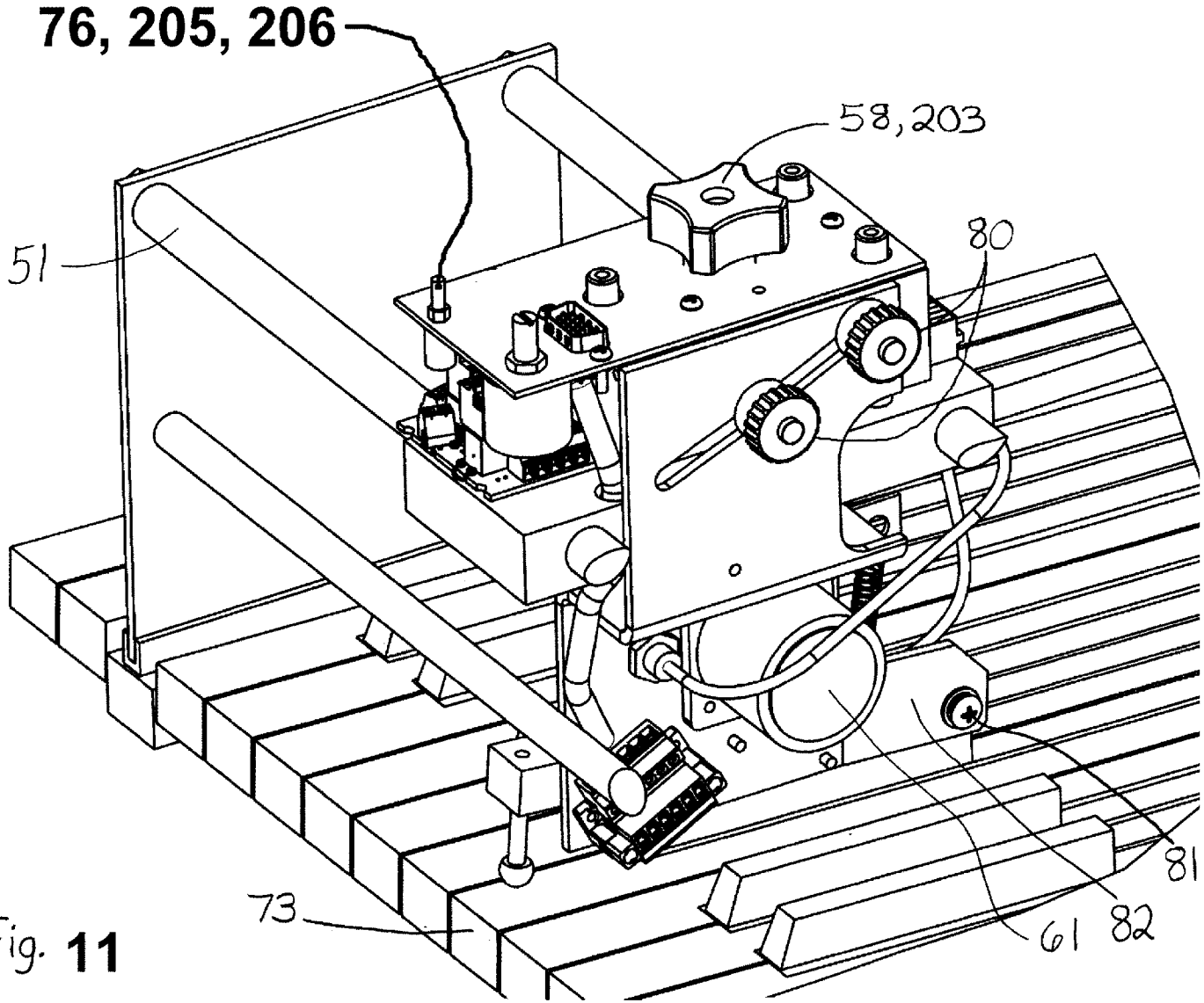
FIG. 11 is an alternate fragmentary perspective view of the device shown in FIG. 10, with certain parts of the device being broken away and not shown.
Figure 12:
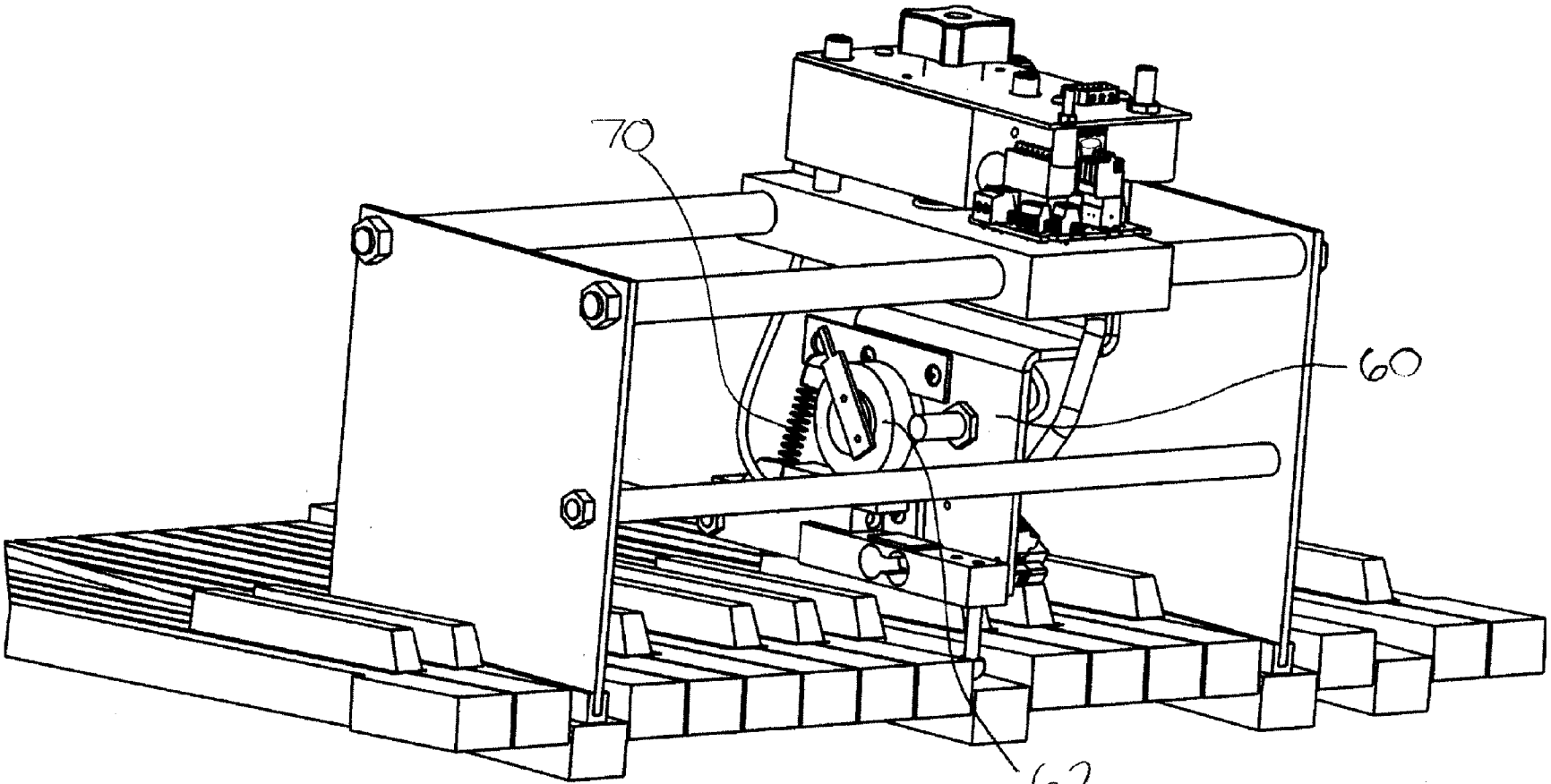
FIG. 12 is an alternate perspective view of the device shown in FIG. 10, showing the device as it appears when displacing a piano key.
Figure 13:
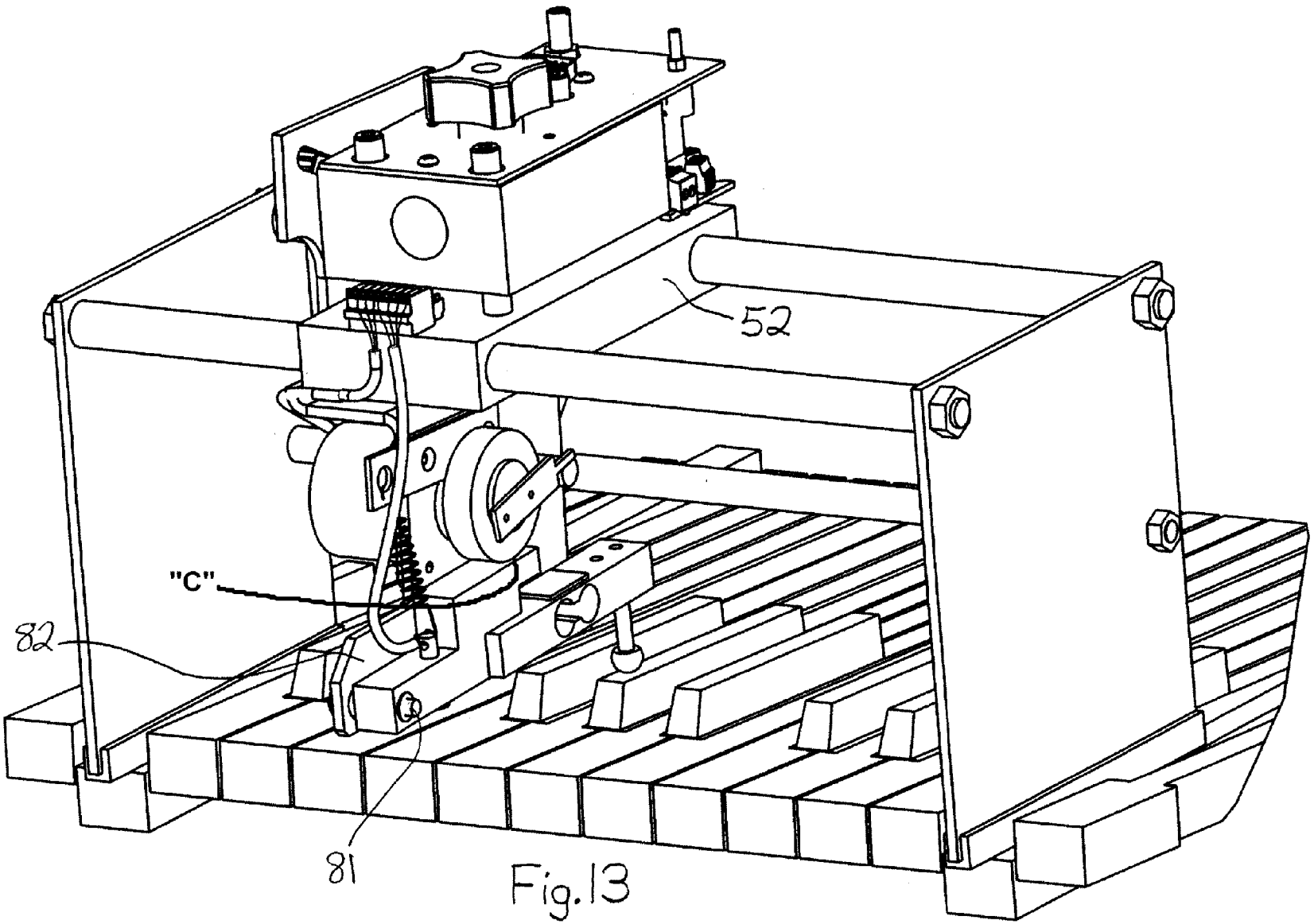
FIG. 13 is an alternate perspective view of the device shown in FIG. 10, the device being positioned on a keyboard for measuring black key parameters, with certain additional components shown as compared with FIGS. 10-13.

One embodiment of the invention is shown in FIGS. 10 through 14. As shown in FIGS. 12-13, a support structure consists of two end plates 50, interconnected by a plurality of rods 51, that rest on the keys of a piano. In general, the apparatus embodiments herein need not be supported by the piano keys themselves. During operation, the embodiments can be structurally supported by any sufficiently strong part or parts of the piano, by the floor or ground nearby, or by any items resting on the piano, floor, or ground. Slidably attached to the rods which have axes that extend laterally across the keys of the piano, is a lower support 52. Coupled to the lower support is an arm 65, consisting of a follower 66, a force transducer 67 (see also, FIG. 10), and a contact 68. The arm 65 pivots about an arm axis 69. Forming the pivot in one embodiment is a shoulder screw 81, affixed firmly in a position normal to a bracket 82, which is securely fastened to a motor support 60. A clearance hole in the follower 66 fits over the shoulder screw 81, allowing the arm 65 to rotate freely about arm axis 69. Secured to, and extending downward from, the force transducer 67 is the contact 68, which engages and excites a piano key 73. The motor support 60 has a motor 61 affixed to one side and a cam 62 situated on the other. The cam 62 is affixed to the output shaft of motor 61, said output shaft passing through a clearance hole in the motor support 60. An upward force is generated on the follower 66 with an extension spring 70, keeping the follower in constant contact with the cam 62 as indicated at "C" in FIG. 13. Mounted on the face of the cam 62, for rotation therewith, is a positioning blade 71 (see also FIG. 10), which causes a voltage output from a position sensor 72, indicative of the angular position of the blade, when the two are in close proximity (i.e., home position). Since the blade is secured to rotate with the cam, and the cam is coupled to rotate with the motor output shaft, the output signal of the position sensor is indicative of the angular position of the motor output shaft. In the embodiment shown, the output signal from the position sensor in turn causes transistor switch TR1 (FIG. 20) to close, sending a "low" voltage signal to an I/O interface of a controlling computer (or other digital processing unit).

Figure 14:
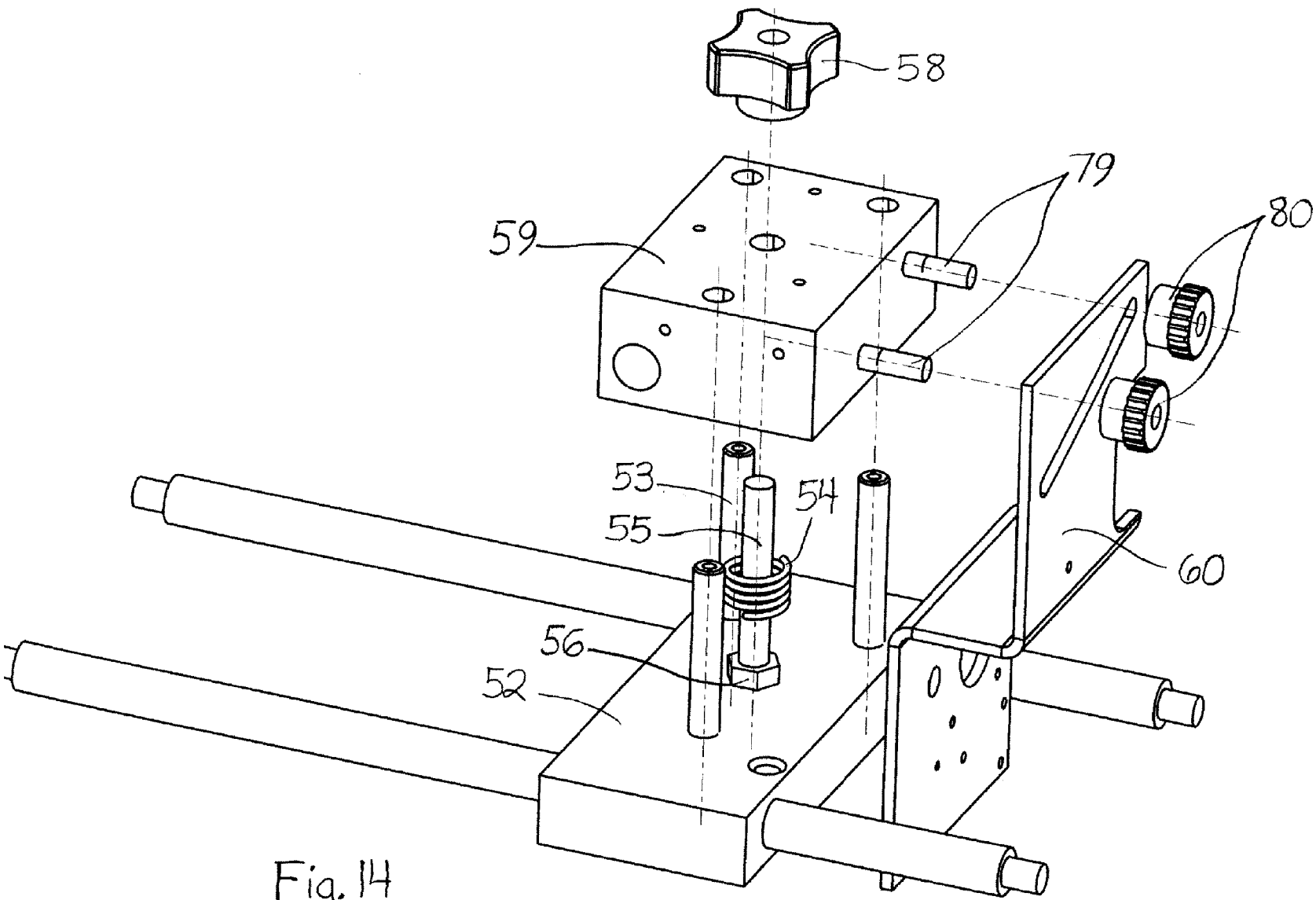
FIG. 14 is an exploded perspective view of vertical-translation means utilized in the device shown in FIG. 10

Referring to FIG. 14, a plurality of dowels 53 are secured to lower support 52, and have their axes substantially vertical. A bolt or threaded stud 55 is fed through the lower support 52, so that a threaded knob 58 can be fastened to its top end which extends above the top of the motor support block 59. One or more nuts 56 secure bolt 55 to lower support 52. One or more springs 54 create opposing force between the lower support 52 and the motor support block 59. The motor support block 59, which contains clearance holes corresponding to the dowels 53, is fastened to motor support 60. As the knob 58 is turned, the Vertical Translation Means—consisting of the dowels 53, the springs 54, the bolt 55, the nut 56, the knob 58, the motor support block 59, and the motor support 60 causes the contact 68 to translate in a substantially vertical direction, as the motor support block 59 slides along the dowels 53. This Vertical Translation Means is the Contact-Adjusting Means for this embodiment. The upward force from springs 54 helps to support the weight of the motor support block 59 and other components, and also to ensure sufficient friction between the knob 58 and the motor support block 59. The friction is necessary so that the motor support block 59 doesn't move along the dowels unless the knob is being turned. The lower support 52 also contains clearance holes for receiving the rods 51 axially cross-wise in relation to the dowels, resulting in a secure but sliding fit that allows the entire vertical-translation means to slide easily in the lateral direction, for use in moving to another key. The motor 61 and the arm 65 are securely fastened to the motor support 60, and therefore translate with it on the rods 51.

Figure 20:
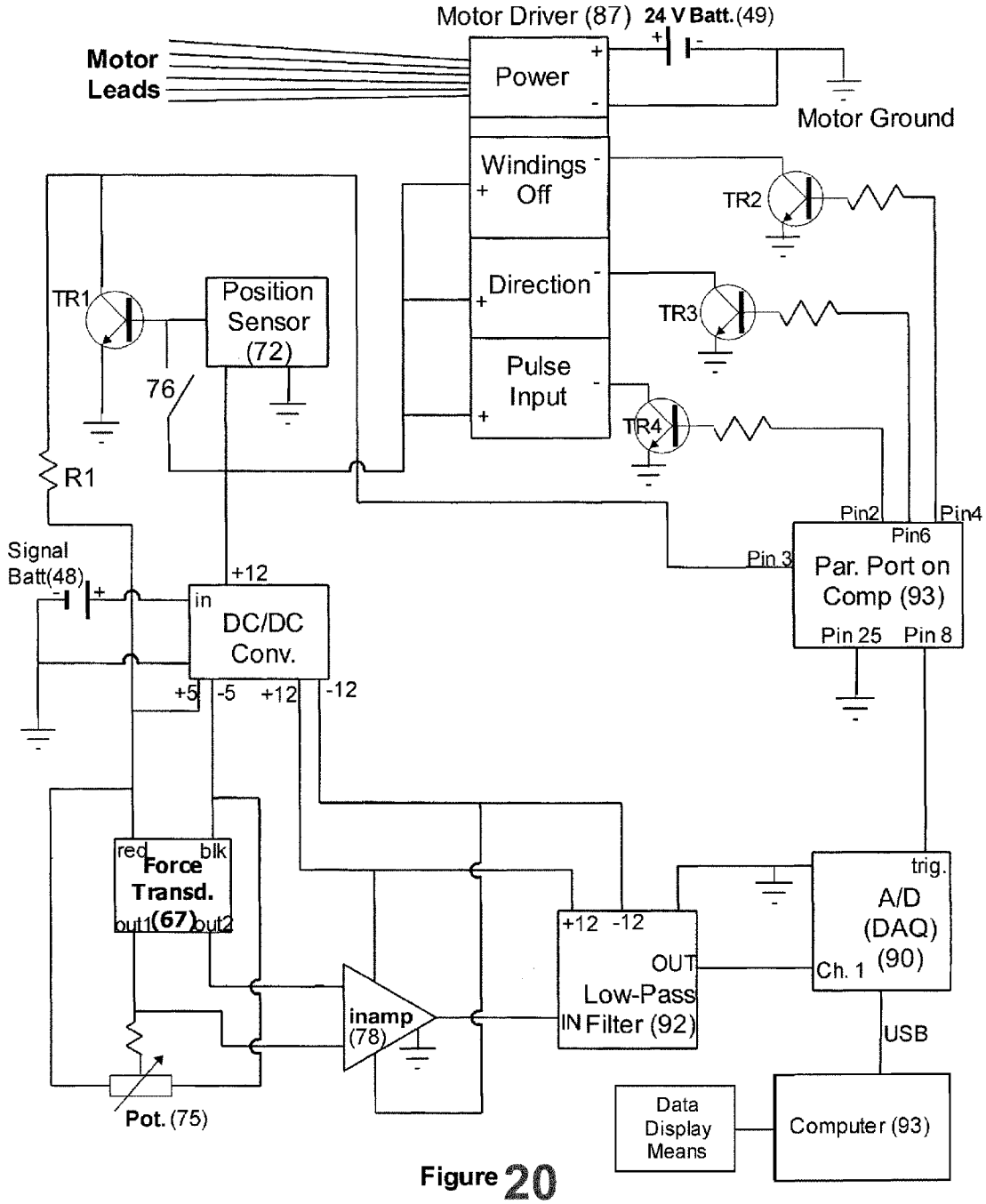
FIG. 20 is an electrical diagram of certain aspects of the invention.

Referring again to FIG. 10, a connector plate 74 is affixed to the upper surface of motor support block 59, overhanging at the front end of the motor support block as shown (the front of the device corresponding to the free end of the keys). Attached and inserted through the connector plate is a potentiometer 75, containing a shaft for easy adjustment. The potentiometer is used to balance the Wheatstone Bridge, or other appropriate circuit, of the force transducer 67. In general, the output voltage from the transducer should be close to zero when the contact 68 is not touching the key. During the Key Address process described above, for use after a Home Address (A) procedure, the potentiometer might be adjusted, if necessary, just before step (1a). Also attached to the plate 74 is a small switch 76, for use in manually activating a run when Key Address is successfully completed. In general, the Run-Activation Means for any embodiment is software and/or hardware that causes the motor to begin the key run. In this embodiment, the small switch 76 serves as the run-activation means, by bypassing the position sensor 72 and causing Pin 3 on the parallel port of computer 93 to go "low" (FIG. 20). During Key Address, the controlling program would take this signal, caused by depressed switch 76, to mean "begin the run". As will be seen later, the run-activation means can also take the form of code in the controlling program. With reference to the Key Address steps above, the run activation would be implemented, via the switch 76, immediately upon completion of step (2a/2b), or step (3) if that optional step is done. A connector 77 is also flange-mounted to the plate 74 as shown, providing electrical power for motor 61 and signals to and from the amplification circuit and force transducer 67. The amplification circuit is attached to the front end of lower support 52, and contains the instrumentation amp or inamp 78, gain resistor, and various connection means for wiring between the potentiometer, motor, switch, connector, force transducer and the position sensor.

On one vertical face of motor support block 59 are two threaded studs 79 (see FIG. 14), affixed firmly to motor support block 59 and protruding normal to face. Mounted against this face, and having a slot to clear the studs 79, is the motor support 60. Screwed onto the studs 79 are two knobs 80 (see also FIG. 11). These knobs, when tightened, keep the motor support 60 firm against the block 59. When transitioning from black to white key measurements, or vice-versa, these knobs are loosened and the motor support 60 slid one way or the other along the slot. This moves the motor 61 and contact 68 in a more optimal position for measuring the other type of key. The configuration shown in FIGS. 10 through 12 is for measuring white keys. FIG. 12 shows the embodiment of the invention as it is fully displacing a key. When necessary to measure black keys, the knobs are loosened and the motor support 60 is slid along the studs to the other extreme position, where the knobs are tightened. The entire assembly is then lifted and turned 180° about a vertical axis, and placed back onto the keyboard. The black keys can then be easily engaged and their action properties measured. FIG. 13 shows the current embodiment in this configuration, ready to measure a black key. So in the current embodiment, the studs 79, knobs 80 and the slot in motor support 60 together make up the Key-Color-Transition Means. That is, a means for quickly changing the vertical location and/or fore/aft location of the contact 68 in preparation for addressing the keys of the opposite color. The black (sharp) keys are approximately one-half inch taller than the white (natural) keys. Furthermore, the front edge of the black keys is typically a couple inches rearward (aft) of the front edge of the white keys. Other means could be used for implementing the Key-Color Transition, including elongated slots in the two end plates 50, which would allow the rods 51 to slide relative to them. When the entire measurement sequence is completed for a given key, the lower support 52 is slid by hand along the rods 51, until the contact 68 is positioned correctly, in a lateral sense, over the key to be measured next.

A description of how the various components of the embodiments work together electrically will now be given. The electrical diagram of FIG. 20 shows an embodiment of applicable circuitry. Other means of performing these functions are possible, and those skilled in the art will readily appreciate that this depiction is not meant to suggest the only way to perform the desired functions. The associated description below is for the case of the motor (61, 61*a*) being a stepper motor, controlled by a stepper motor driver. However, any motor (and corresponding driver and controller) that can produce coupled output motion in an accurate manner can be used in the embodiments of this invention. A "signal" battery 48 is connected to a "signal" ground, and provides power to one or more DC/DC converters, which together provide the necessary "signal" voltages. The DC/DC converter in FIG. 20 is shown as a single device, but can represent two or more separate converters. All ground connections in FIG. 20 are "signal" ground, except for the "motor" ground, to which the 24 V (volts) battery 49 is connected. The 24V battery 49 is what powers the motor driver 87. This is the power that eventually makes its way to the windings of the motor 61. It is seen in FIG. 20 that both the (+12) voltage and the (−12) voltage are needed for the inamp 78 and the Low-Pass Filter 92. The (+12) voltage is further required for the position sensor 72 and the three control inputs (Windings Off, Direction, and Pulse Input) on the motor driver 87. The "signal" ground is connected to: the "signal" battery 48, the inamp 78, the position sensor 72, the Low-Pass Filter 92, the A/D (analog-to-digital) converter 90, a pin on the parallel port of computer 93, and all four transistor switches or relays. The (+5) and (−5) voltages are connected to the force transducer 67 and the potentiometer, which is used for balancing the force transducer 67. The (+5) voltage is further used for connecting, through a resistor R1, to the collector pin (top of transistors in FIG. 20) of the NPN transistor relay TR1 near the position sensor 72. Resistor R1 is sized so that when the transistor TR1 is "closed", the current across it, from collector to emitter (which is at signal ground) is well below the transistor's maximum-allowed value. As seen in FIG. 20, the (+5) voltage is also connected, through the same resistor R1, to Pin 3 of the parallel port of computer 93. This ensures that Pin 3 sees a "high" voltage except when "home position" has occurred. During "home position", the position sensor 72 outputs a voltage to the base pin of the transistor relay TR1, effectively closing the transistor "switch" between the collector and the signal ground. When this happens, the voltage at the collector of transistor relay is reduced significantly due to the (+5) voltage dropping across resistor R1, and on to ground through the transistor. This low voltage at the collector is immediately sensed by Pin 3 of the parallel port of computer 93, causing the motor control means to stop the Home Address and revert to the Key Address process. In the embodiments shown in the drawings, the Motor Control Means is code written in the controlling program to move the motor, and also includes the necessary controlling pins 2, 4, and 6 on the parallel port (I/O interface components), along with their corresponding transistor relay circuits. In general, the Motor Control Means consists of software and hardware which provide the signals, necessary for motor output shaft positioning, to the motor or motor/driver combination. The manual switch 76 is used to manually begin a RUN at the end of the Key Address process by bypassing the position sensor and bringing 12 V to the base of the transistor TR1. This "closes" the transistor relay, thus bringing Pin 3 of the parallel port to a "low" state. During Key Address, the controlling program sees this as a signal to begin the actual run. The switch 76, as mentioned previously, is a manual version of the Run-Activation Means.

Still referring to FIG. 20, the two output voltages (opposite corners of the Wheatstone bridge) of the force transducer 67 are received by the inamp 78. The inamp 78 outputs a voltage, relative to signal ground, that is proportional to the difference in these two input voltages. By installing an appropriate gain resistor onto the inamp 78, the output voltage is amplified greatly. The output voltage from the inamp 78 goes into a Low-Pass Filter 92, which filters out unwanted higher frequencies from the signal. The filtered signal then goes into the A/D converter 90, which samples the continuous analog signal very frequently, and converts each sample into digital data. This data, for every run, is subsequently transferred to the computer 93 via a USB connection, and stored. The A/D converter 90 is instructed by the controlling program, via Pin 8 on parallel port of computer 93, as to when to begin each sampling "run". Pin 8 is connected to a Trigger pin on the A/D, so the sampling begins as soon as the appropriate signal is received at the Trigger.

Regarding the three transistor relays TR2, TR3 and TR4 near the top-right of FIG. 20, their base connections (to their right, in FIG. 20) are each connected to a corresponding pin on the parallel port of computer 93. As noted above, the three control circuits in the motor driver 87 (Windings Off, Direction, and Pulse Input) are connected on one end to (+12) volts. But no current flows through them until the base of the corresponding transistor relay is made "high" by the corresponding pin of the parallel port. The Windings Off circuit, within the driver 87, is set up so that the motor windings are turned off whenever current is flowing through that circuit. That is, in the embodiments, when the corresponding transistor relay TR2 is "closed" (due to Pin 4 being "high"), then current is allowed to flow through the Windings Off circuit of driver, and the motor windings are all turned off. When the TR2 is not "closed", then the windings do whatever they are supposed to do, based on the Pulse Input circuit (discussed below). Regarding the "Direction" circuit of the driver 87, when current flows through that circuit of the driver, the motor steps in one direction (CW). When current flow stops, the motor steps in the opposite direction (CCW). And similar to the Windings Off circuit, current is made to flow or not by turning on or off the corresponding transistor relay TR3 with Pin 6 of the parallel port. So, Pin 6 would be constantly "high" while the motor is stepping in one direction, and then switched to constantly "low" for stepping in the opposite direction. The "Pulse Input" circuit of the driver is set up so that whenever a transition is made from "current flowing" to "current not flowing", the motor takes one step. Looking at the corresponding transistor relay TR4 in FIG. 20, one sees that the motor therefore steps whenever Pin 2 of the parallel port goes from High to Low. As mentioned previously, the pins 2, 4 and 6, their corresponding transistor relay circuits, and the motor output control portion of code within the controlling program (described in the flowcharts of FIGS. 21 through 25), form the Motor Control Means of this embodiment.

In the apparatus embodiments of the invention such as described and shown, the blade 71 and position sensor 72 could be replaced by an encoder that rotates, or translates, with the motor shaft, depending on the type of motor involved. The encoder would then provide the output signal indicative of the position of the motor. Based on the geometry of the various parts of the embodiments, one could quickly determine the corresponding output signal of some desired "home position". So during operation (the Home Address process), as soon as the computer 93 sensed that predetermined output signal from the encoder, it would know the motor was at home position and end its movement. In this manner, the encoder would replace the functionality of the blade 71 and position sensor 72.

In general, the pins 2, 4, and 6, which are part of the motor control means, could be external to the computer 93. One embodiment would have the main program still reside on the computer 93, and it would communicate with a separate "black box" that has its own output pins for controlling the motor(s). The "black box" would have its own processor that is programmed with all the necessary code for controlling the motor(s) via the output pins. Whenever motor output shaft movement was required in the main program, control would be given to the processor in the "black box". The embodiment might also have Pin 3 and Pin 8 reside on this "black box". This would leave the USB connection as the only means of communication between the computer 93 and the other components. So in that embodiment, the Motor Control Means would include the output pins, along with the microprocessor code in the "black box" that is controlling them. Other embodiments might have the entire controlling program reside in this "black box", with the data stored there for eventual retrieval by a flash drive or other date storage memory device.

Figure 21:
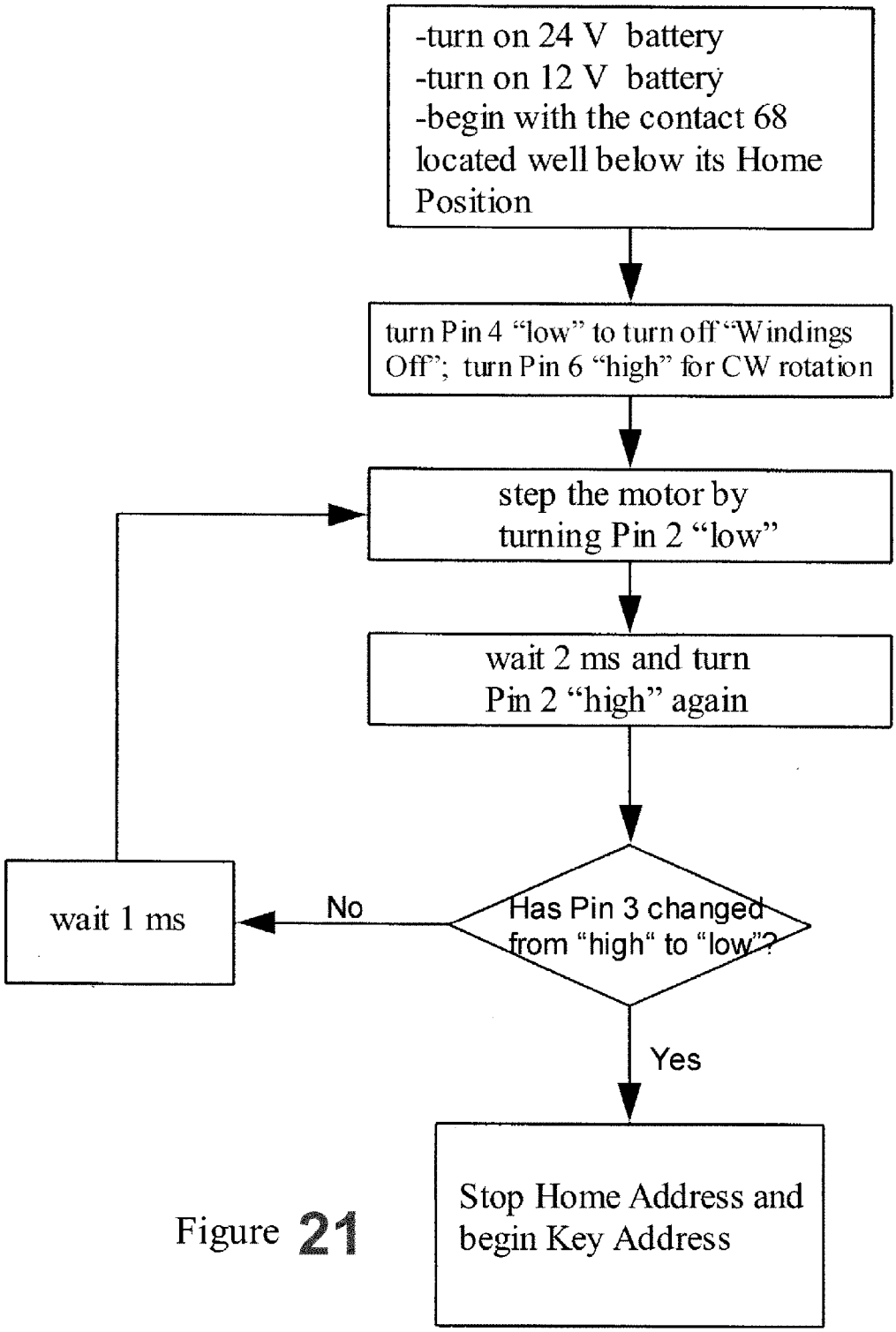
FIG. 21 is a flowchart showing a home address process according to the invention.
Figure 22:
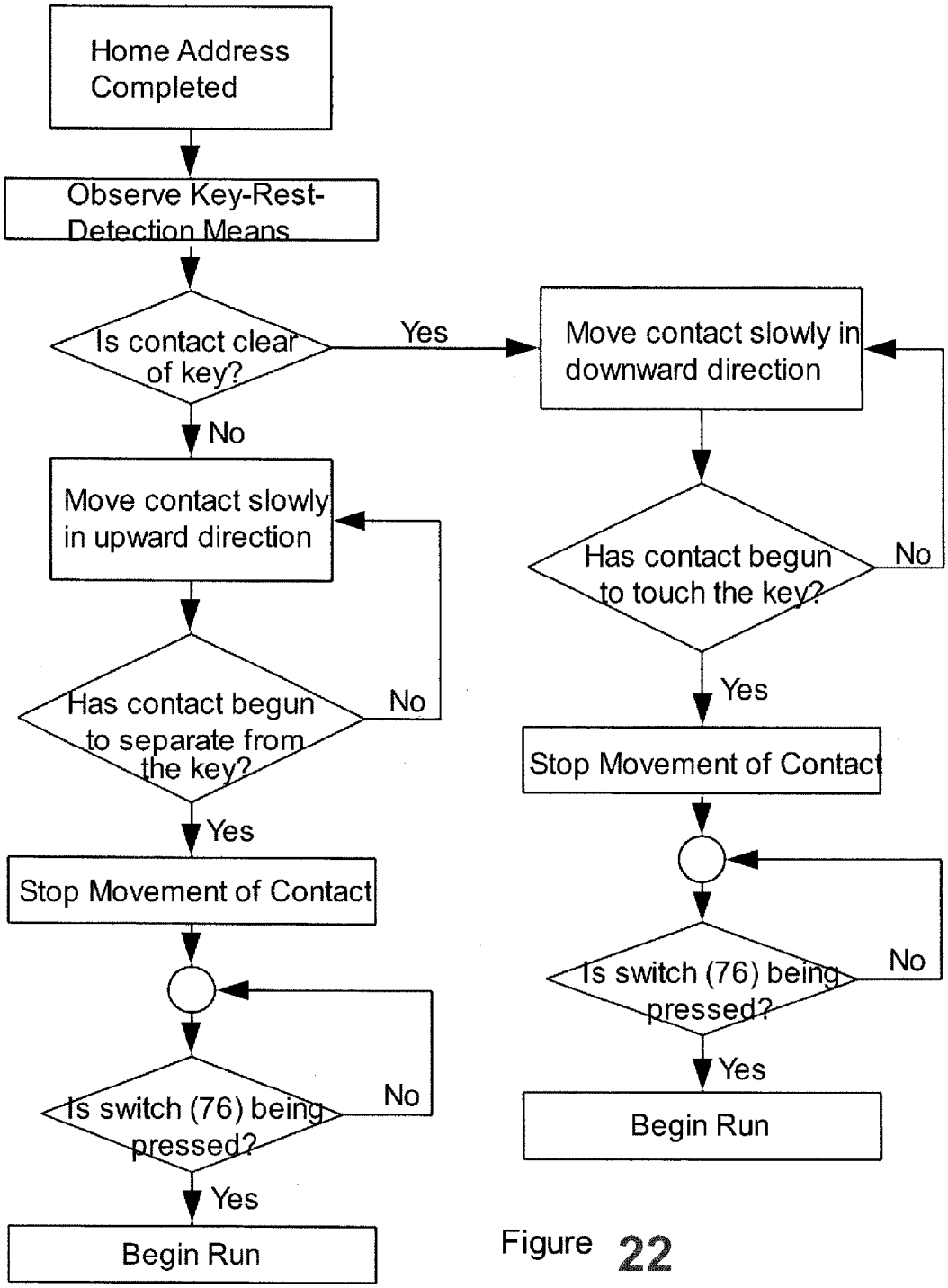
FIG. 22 is a flowchart showing an overview of a key address process according to the invention.

The flowchart of FIG. 21 summarizes the events surrounding the Home Address process. Pin 2 must be set to "high" at the beginning of this process. FIG. 22 shows the steps involved in performing Key Address. This flowchart is geared towards the purely manual Key Address. It would be adjusted somewhat, as described above and as will be readily apparent to those skilled in the art, for embodiments using the automated Key Address. The steps involved in performing a Key Dip Evaluation run, per the embodiments, are shown in the flowchart of FIG. 23. Note that an ASCII "time file" and an ASCII "displacement file" are first read by the controlling program, with the individual lines stored in arrays. Each line of the displacement file represents the net contact displacement for each successive step of the motor, up to the maximum displacement of the contact. The total number of steps is "N". Each line of the "time file" represents the time corresponding to the respective displacement line (or motor step), in order to generate some predetermined Displacement vs. Time curve. In the case of the Key Dip run, this predetermined curve is a constant-speed downstroke, with a short acceleration region near the beginning. The curve would look similar to that of FIG. 8, except that the displacements would go all the way to 10.5 or 11 mm. The "threshold force", referred to as $F_{thr}$, is the same as described earlier—large enough to overcome let-off resistance. Of course, the damper lever is disengaged. Pin 2 must be initially set to "high", and Pin 6 initially set to "low". The value of $F_{prev}$ is initialized to zero, so the program can get through the first loop. And "BottCount" is initially set to zero as well. This same process was described in the above section "Improved Method of Measuring Key Dip".

Figure 24:
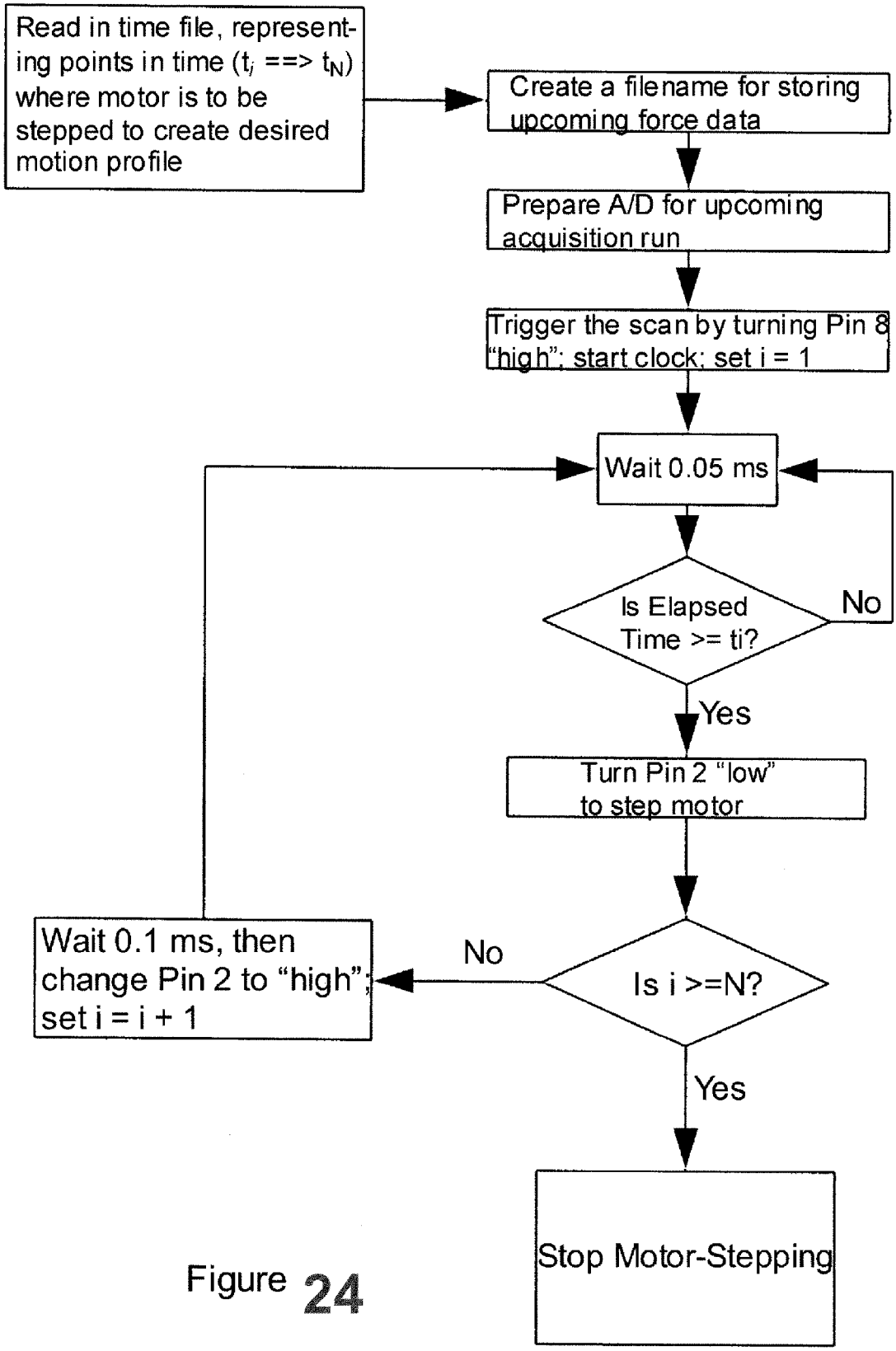
FIG. 24 is a flowchart showing a key run process for a down-only run, according to the invention.
Figure 25:
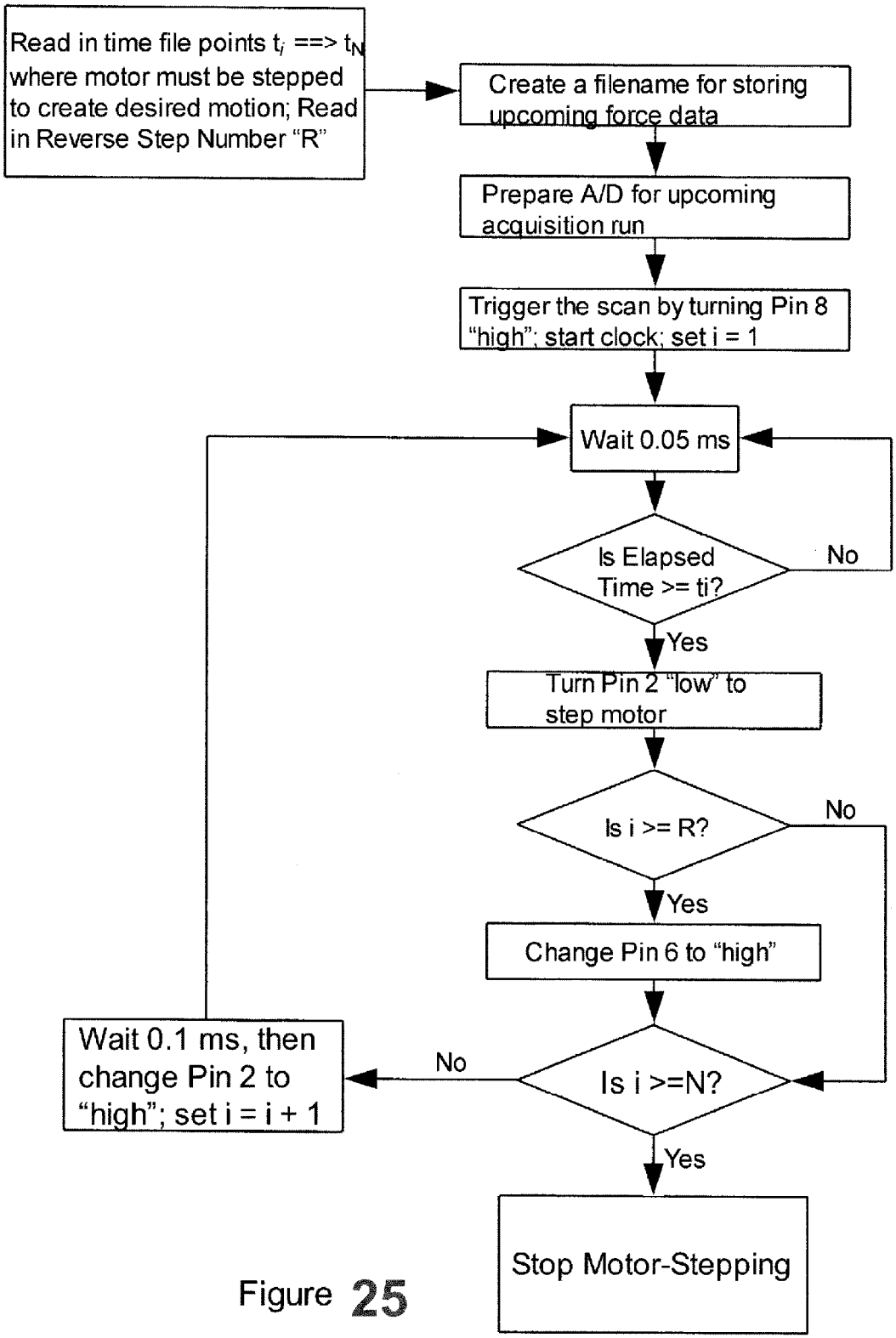
FIG. 25 is a flowchart showing a key run process for a down-and-up run, according to the invention.

Some runs, like the Key Dip run just described, can implement the "sampling" of the force signal right into the loop that actually causes movement of the motor output shaft. A data point is taken at every motor step; that is, each time through the loop. But sometimes, one needs the sampling rate to be independent of the motor stepping rate. Many A/D devices have a "scan" mode, where the A/D is "triggered", after which it samples the input signal at some given frequency. With regards to the apparatus embodiments herein, certain types of runs are best accomplished in this manner. The flowcharts in FIGS. 24 and 25 describe this sort of run. FIG. 24 describes a run that only needs force data taken as the contact 68 moves down. Its upward, return movement is only a means to return to Home Position, and need not be well-controlled. FIG. 25 describes a run that requires force data sampling in both the down and up directions of the contact 68. The example of FIGS. 8 and 9, where DF and UF were measured, is such a run. In both FIGS. 24 and 25, an ASCII "time file" is first read in by the program, and stored as an array. This file represents the successive points in time where the motor must step in order to create the desired Displacement vs. Time profile. In addition, FIG. 25, for the Down-and-Up run, requires that a Reverse Step parameter be read in as well. This is referred to in the figure as "R", and tells the program at which step it needs to reverse its direction from down to up. In both FIGS. 24 and 25, the Sampling Rate and Total Number of Data Points must also be determined beforehand. A "trigger" signal is sent to the A/D, as seen also in FIG. 20, just before the contact begins moving, causing it to continuously sample an input channel at the predetermined frequency. It will sample the input signal at that frequency until the given number of data points are obtained. Meanwhile, the program loop causes the motor to take a step at each "$t_i$", from i=1 to N, listed in the time file. In the "down-and-up" run of FIG. 25, a further check occurs in the loop that causes the motor to switch from CCW- to CW—rotation at step "R".

As those skilled in the art will readily appreciate, apparatus according to the invention may be implemented in many variations, such as, but not limited to the following described alternate embodiments.

Different embodiments of the invention, very similar to that of FIGS. 10 through 14, would have the knob 58 replaced by an auxiliary motor 203. One embodiment would have an auxiliary switch 206 that would be depressed or otherwise actuated to rotate the auxiliary motor in either direction. A rocker switch, for example, would work well for this purpose. Another embodiment would have two auxiliary switch mechanisms, one for rotating the auxiliary motor CW, and one for rotating it CCW. In these embodiments, the stud 55 would likely be replaced with a low-friction linear output motion device such as, for example, a ball screw. In this instance, the ball screw or ball screw nut would be coupled to the output of the auxiliary motor. If the auxiliary motor is fastened to the motor support block 59, and turns a ball screw nut, then the ball screw would be securely fastened to the lower support 52. Rotation of the auxiliary motor would then result in the motor support block translating vertically with respect to the lower support 52. There might be code in the controlling program which, during Key Address, would interpret the depressed switch as a signal to rotate the auxiliary motor fairly slowly in the given direction. In these embodiments, the Vertical-Translation Means would include the auxiliary motor, the auxiliary switch (or switches), the relevant code in the controlling program, the ball screw, the ball screw nut, the motor support block 59, the dowels 53, and the motor support 60. In yet another embodiment, code in the controlling program would rotate the auxiliary motor automatically during Key Address, in the proper direction. In this embodiment, the Vertical-Translation Means would be the same as above, with the exception of the auxiliary switches (which would be eliminated). And in all embodiments, where there is a vertical-translation means, it can serve as the contact-adjusting means of the invention. Another embodiment would have the controlling program react to the signal from the Key-Rest-Detection Means during Key Address, thus eliminating the need for the run-activation switch 76. As soon as the controlling program detected, from the Key-Rest-Detection Means signal, that the contact was barely touching the key in its rest position, it would stop the Key Address movement and begin the actual run. So in this embodiment, the Run-Activation Means would simply consist of the relevant code in the controlling program.

For those embodiments where a second or auxiliary motor is used, such as described above to implement powered vertical translation means, there could be a separate motor driver for the auxiliary motor, with a relay to toggle between the two motor drivers as necessary. The relay would switch the incoming 24V signal between the two drivers, and the motor controlling outputs (pins 2, 4 and 6) would be connected in parallel between the two drivers. Another embodiment would have only one driver, but with a relay on one or more of the motor leads from the driver. So the motor leads would go to both motors in parallel, but one or more of the leads would first go to a Single Pole Double Throw relay, which would send that signal on to whichever motor was required at the time.

A different embodiment would eliminate the cam, and would incorporate a spur or helical gearset to couple the motor shaft rotation with the arm 65. Any other parallel-shaft gearset could also be used, although space limitations could limit the reduction ratio. In general, the relative size of the two gears would be designed so that the torque at the arm axis 69A would be increased, and its rotation speed decreased, relative to the motor shaft. A similar embodiment would utilize a belt drive, with differing pulley sizes to generate the speed reduction. In fact, any sort of rotary-transmissive means could be used in the embodiments of this paragraph. Regarding Key Address, it could be accomplished with the same Vertical-translation means of the embodiments depicted in FIGS. 10 through 14. Or it could be accomplished by slowly rotating the motor 61 while simultaneously monitoring the signal from the Key-Rest-Detection Means. Embodiments utilizing this method of Key Address could have the entire system of the Vertical-translation means (to accomplish vertical movement of the contact as described above) removed. (Technical aspects of elimination of the vertical-translation means is discussed below.) In this instance, the vertical movement of the contact mentioned in Key Address steps (1a) and (1b) above would instead be accomplished by slowly rotating the motor 61. Similarly, the stopping of the contact's vertical movement, mentioned in steps (2a) and (2b), would be done by ending the slow motor rotation. For these actions, there could be an additional key address switch 205 on the machine, which would continually rotate the motor at a given speed when depressed. Or there could be two key address switches: one for rotating in one direction (for use with Home Address (A)) and one for rotating in the opposite direction (for use with Home Address (B)). A portion of code in the controlling program, in this embodiment, would respond to the depressed key address switch signal by rotating the motor at a slow constant rate in the desired direction. So in these embodiments, where Vertical-Translation Means is not used for Key Address, the Contact-Adjusting Means consists of the motor 61, the key address switch or switches, and the associated code in the controlling program which recognizes the switch signals and increments the motor.

Figure 15:
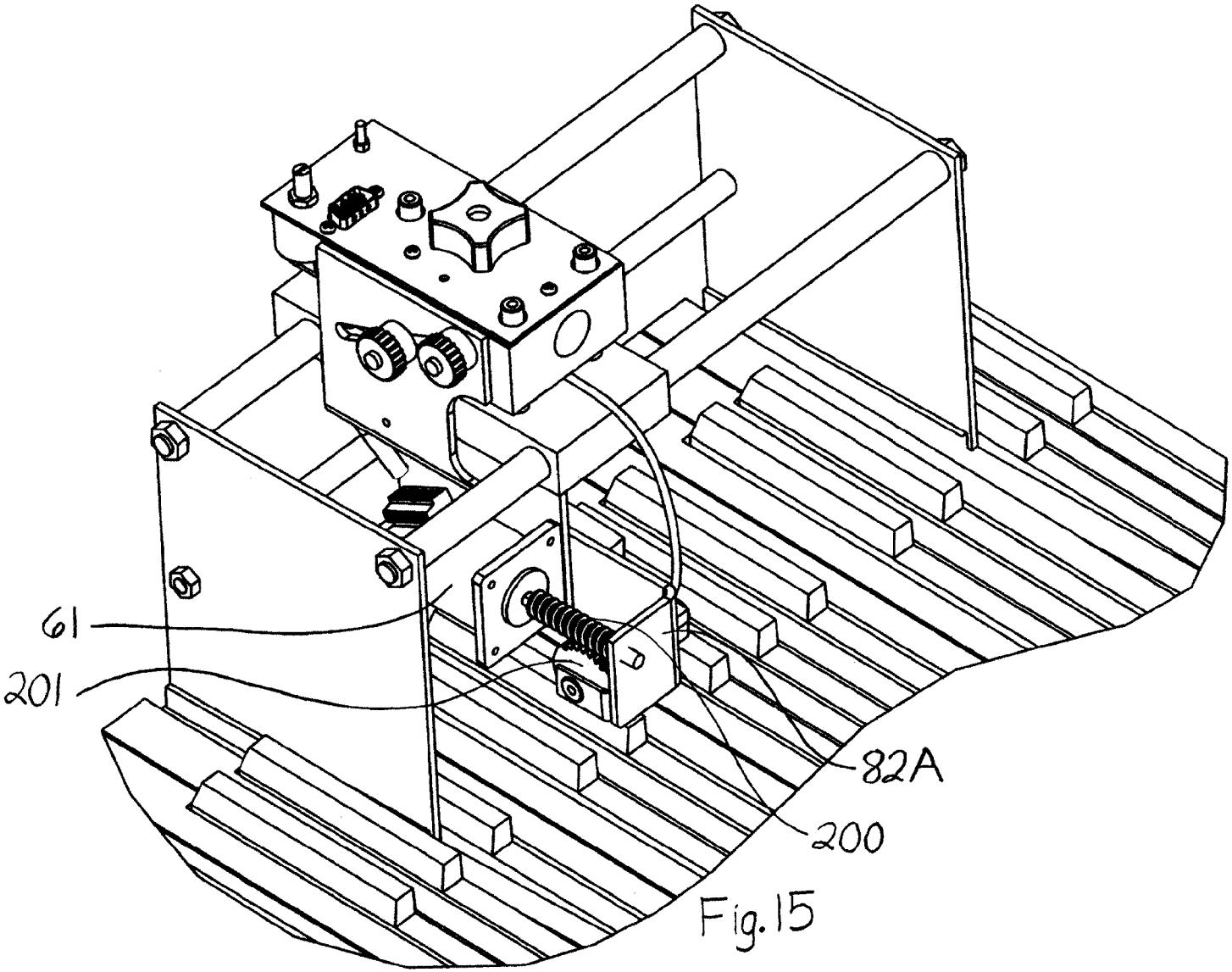
FIG. 15 is a perspective view of an alternate embodiment device configured for use with and in accordance with certain aspects of the invention, the device being shown as on a keyboard for practicing certain methods of the invention.
Figure 16:
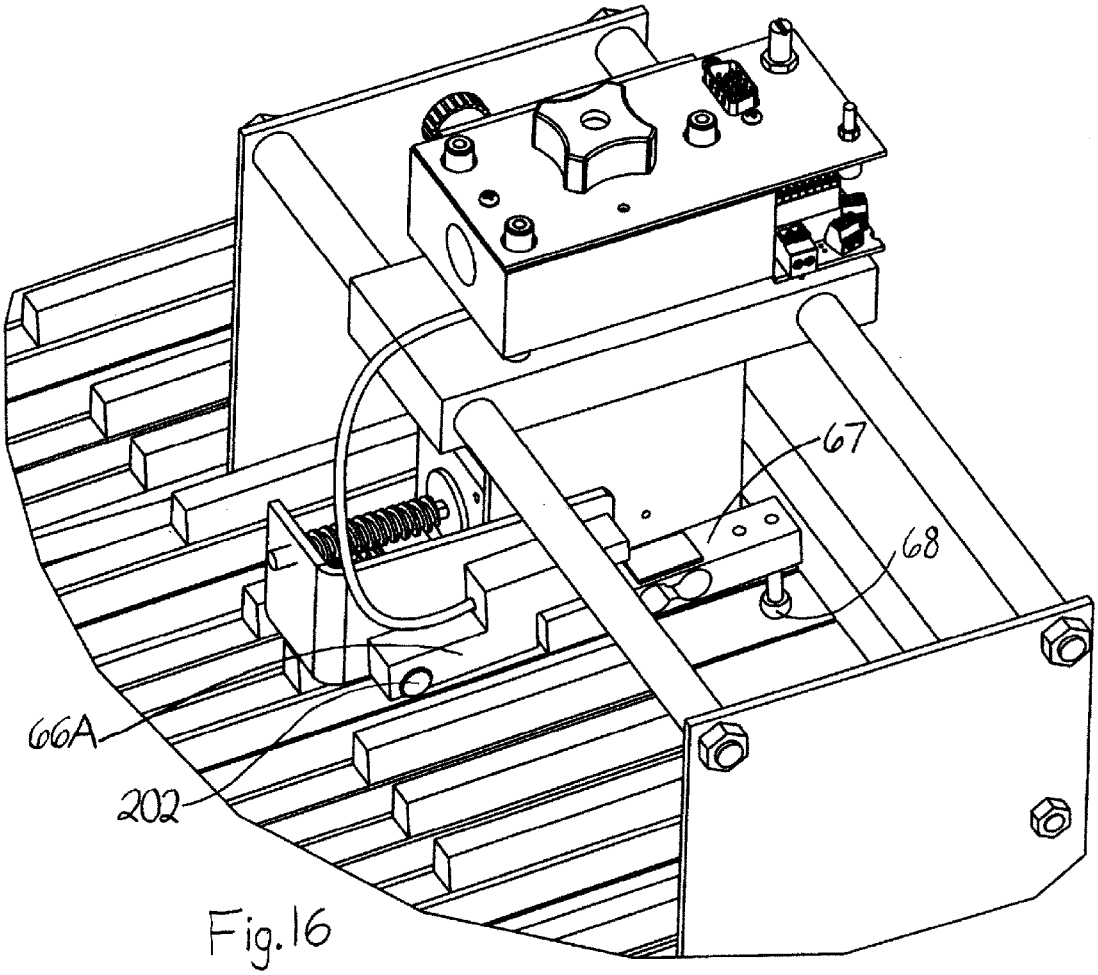
FIG. 16 is an alternate perspective view of the device shown in FIG. 15, with certain additional components shown as compared to FIG. 15.

Another embodiment of the invention is shown in FIGS. 15 and 16. Relative to the previous embodiments, the motor 61 has been rotated 90 degrees about the vertical, and has its output shaft connected to a worm 200, which meshes with a worm gear 201. The motor 61 is still attached to the motor support 60. The bracket 82A rotatably supports the end of the worm 200 opposite the motor output shaft. The worm gear 201 is affixed to the shaft 202. The shaft 202 is rotatably supported in a hole (not shown) of the bracket 82A between the worm gear 201 and the follower 66A. The shaft 202 is also rotatably supported in a hole in an L-shaped angle (see FIG. 15) that is secured to the bracket 82A. The follower 66A is affixed to the end of shaft 202 so that the follower 66A rotates (i.e., swings about the center of the shaft 202) with the shaft 202. In this embodiment, the arm is again the combination of the follower 66A, the force transducer 67, and the contact 68. There is no cam. The motor is coupled to the arm via a worm gear arrangement. Since the embodiment shown in FIGS. 15 and 16 has the same vertical-translation means (note the separate motor support block 59, dowels 53, bolt 55 and knob 58 as the embodiment of FIGS. 10-14, the process of key address can be done in the same manner. However, it can also be accomplished by fine movements of the motor 61, as was done in the parallel-shaft gearset embodiment described above. So for this embodiment, the Contact-Adjusting Means would consist of: the motor 61, the "key address" switch or switches, and the associated code in the controlling program which recognizes the switch signals and increments the motor.

A variation on any of the above embodiments that do not use a Vertical-translation means for Key Address would have the contact movement of Key Address performed automatically by the motor control means, as soon as Home Address is finished. In this situation, there would be no need for the "key address" switch(es). The Contact-Adjusting Means would then consist of the motor 61 and the portion of code in the motor control means that increments the motor. A variation of these embodiments would also have the controlling program react to the signal from the Key-Rest-Detection Means during Key Address, thus eliminating the need for the run-activation switch 76. As soon as the controlling program detected, from the Key-Rest-Detection Means signal, that the contact was barely touching the key in its rest position, it would stop the Key Address movement and begin the actual run. So in these embodiments, the Run-Activation Means would simply consist of the relevant code in the controlling program. The Key-Color-Transition Means is identical or very similar in these embodiments to that of the embodiments of FIGS. 10 through 14.

Another embodiment would be identical to that of FIGS. 15 and 16, with the exception that the vertical-translation means would be entirely gone. That is, the motor support block 59, the knob 58, the dowels 53, the bolt 55, the spring 54 and the nut 56 would be gone. The two studs 79 would be part of or fixed to the lower support 52, which would be thicker (similar to the thickness of motor support block 59 in previous described embodiments) in the vertical direction. The motor support 60 would look and perform very similar to the previously described embodiments, but it would pass over these studs and mate against the lower support 52, rather than against the motor support block 59. The Key-Color-Transition Means would thus be the same as in the previously described embodiments, except that the studs are fastened to a different block (the lower support 52). The necessary vertical movements of the contact during key address would also be accomplished as in previous described embodiments: that is, by rotating the motor fairly slowly, either automatically or through use of one or two separate "key address" switches as already discussed.

The reason these "geared" embodiments can utilize the motor 61 for the required Key Address movement, eliminating the need for the vertical-translation means, is now briefly described. As long as the arm angle, relative to the top of the key 73, stays below some reasonably small value (6 or 7 degrees at least), the resulting tangential displacement "s" at the contact (contact point) is very close to its component in the vertical (or key-normal) direction. So the same motor angle vs. time profile can be used, even if one key sits 2 or 3 mm above the previous key. For this higher key, the arm may begin the run at 4 degrees above horizontal and end at exact horizontal, with some resulting vertical displacement "a". For the previous key then, the arm may have only started the actual run at 1 degrees above horizontal, and ended it at 3 degrees below horizontal, with a resulting vertical displacement "b". But for these small angles, "a" is going to be extremely close to "b", just based on the trigonometry. Moreover, if the angular position of the contact is sensed or measured or reasonably approximated, the small difference between the tangential displacement and vertical component movement of the contact can be calculated and accounted for in the controlling program, if desired.

On the other hand, with the embodiment of FIGS. 10 through 14, where a cam/follower was involved, a complication arises in that the ratio of arm angle change to motor angle change does not stay constant as the motor rotates. This is due to the trigonometry of the particular cam/follower arrangement. If the actual run started when the follower was at its topmost position, a 1-degree motor rotation would result in a displacement at the contact of almost zero. If the run started when the follower was further down (say, for a lower key top), then a 1-degree motor rotation would result in a significantly greater displacement at the key. In fact, every different start point would result in a different initial displacement at the key. And of course, for the same reason, the contact displacement produced during the second degree, and the third degree (and so on) of motor travel will also be different, when the start position of the follower is different. So an entirely different motor input ASCII "time file" (i.e., motor angle vs. time) would be needed for every possible start position of the follower/contact. And it should be noted that, even on the same key, because of the felt material between the back of the key and the key bed, the key very seldom returns to exactly the same rest position twice in a row. So even while implementing several runs on one key, the contact would have to be moved up and down accordingly at the start of each run. With the cam/follower design, if not for the vertical-translation means, a different motor input file would have to be chosen for each start position of the follower/contact. Therefore, using the vertical-translation means, which translates the entire motor/follower/contact arrangement, to achieve key address is quite advantageous for that particular embodiment.

Figure 17:
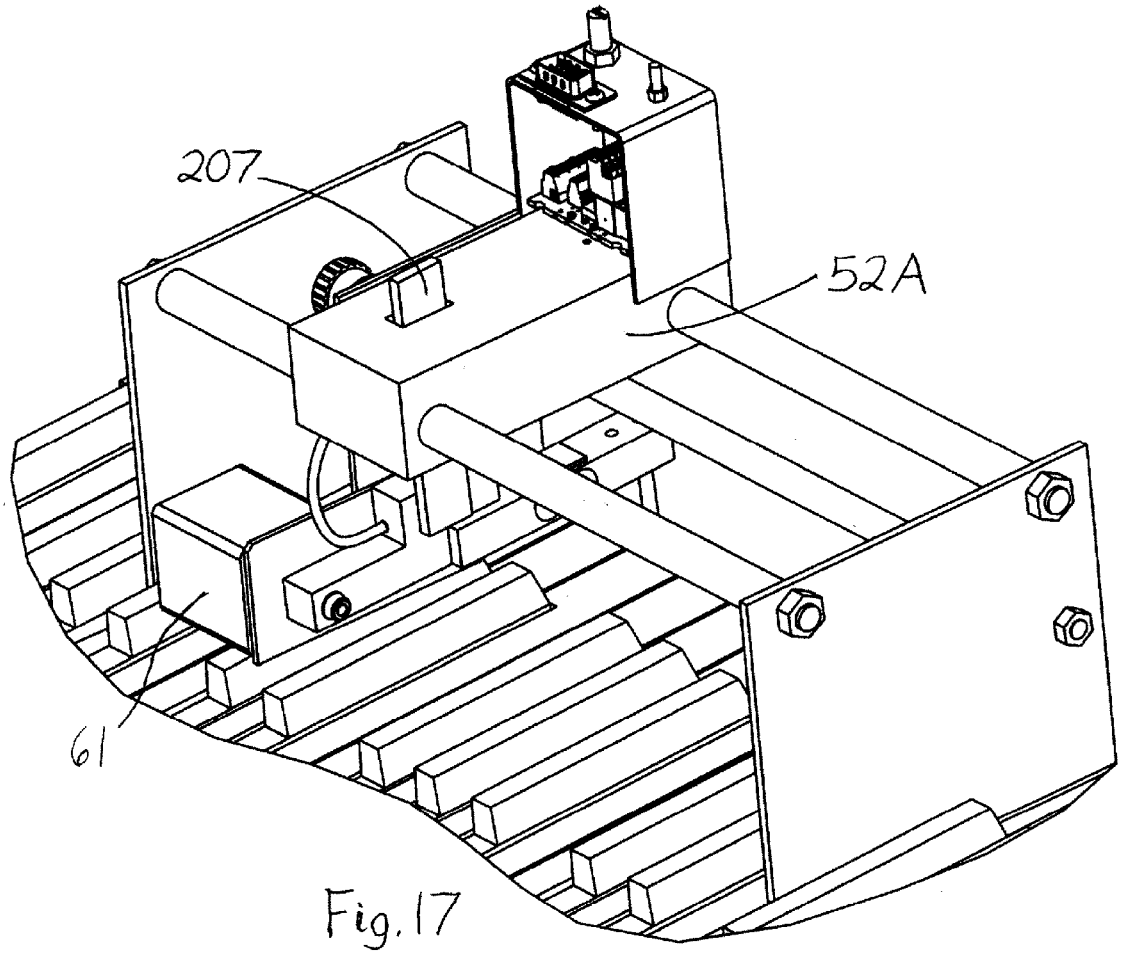
FIG. 17 is a perspective view of a second alternate embodiment device configured for use with and in accordance with certain aspects of the invention, the device being shown as on a keyboard for practicing certain methods of the invention.

Another embodiment is shown in FIG. 17. In it, the rotary motor 61 is moved rearward and its shaft positioned coaxially with axis 69, so that the motor shaft and the arm 65 are coupled directly to rotate together, at the same speed. The cam is gone, and there are no gears. If the motor is a stepping motor, it would have to be micro-stepped in order to provide enough resolution of angular motion. Even for a fairly long arm (say, 5 inches), an 11 mm displacement of the contact 68 only amounts to an angular movement of less than 5 degrees. One would like sufficient resolution so that there were at least, say, 100 steps making up this 5 degree movement. That amounts to 0.05 degrees per step. There are stepper motors on the market, with sophisticated micro-stepping drives, that are capable of steps even smaller than this. The Key Address for this embodiment could be accomplished with the same Vertical-translation means of the embodiments depicted in FIGS. 10 through 14. Or it could be accomplished by slowly rotating the motor 61 while simultaneously monitoring the signal from the Key-Rest-Detection Means. Embodiments utilizing this method of Key Address could have the entire system of the Vertical-translation means removed. The vertical movement of the contact during Key Address would be made by slowly rotating the motor 61. Similarly, the stopping of the contact's vertical movement during Key Address would be done by ending the slow motor rotation. For these actions, there could be one or two "key address" switches, as mentioned in the above embodiments. Or, as mentioned above, one could have the Key Address movements of the motor begun and carried out automatically, upon completion of Home Address. A vertical leg 207 might be fastened to the arm, so that it protrudes upwards through a slot in the lower support 52A. The long edges of this slot could be filled with some material that would provide some friction for the moving vertical leg 207. This would prevent the arm from dropping if the windings of the motor were needed to be turned off. An extension spring between the top of follower and the bottom of lower support might also be employed to reduce the moment about axis 69, thereby minimizing the amount of friction required.

Figure 18:
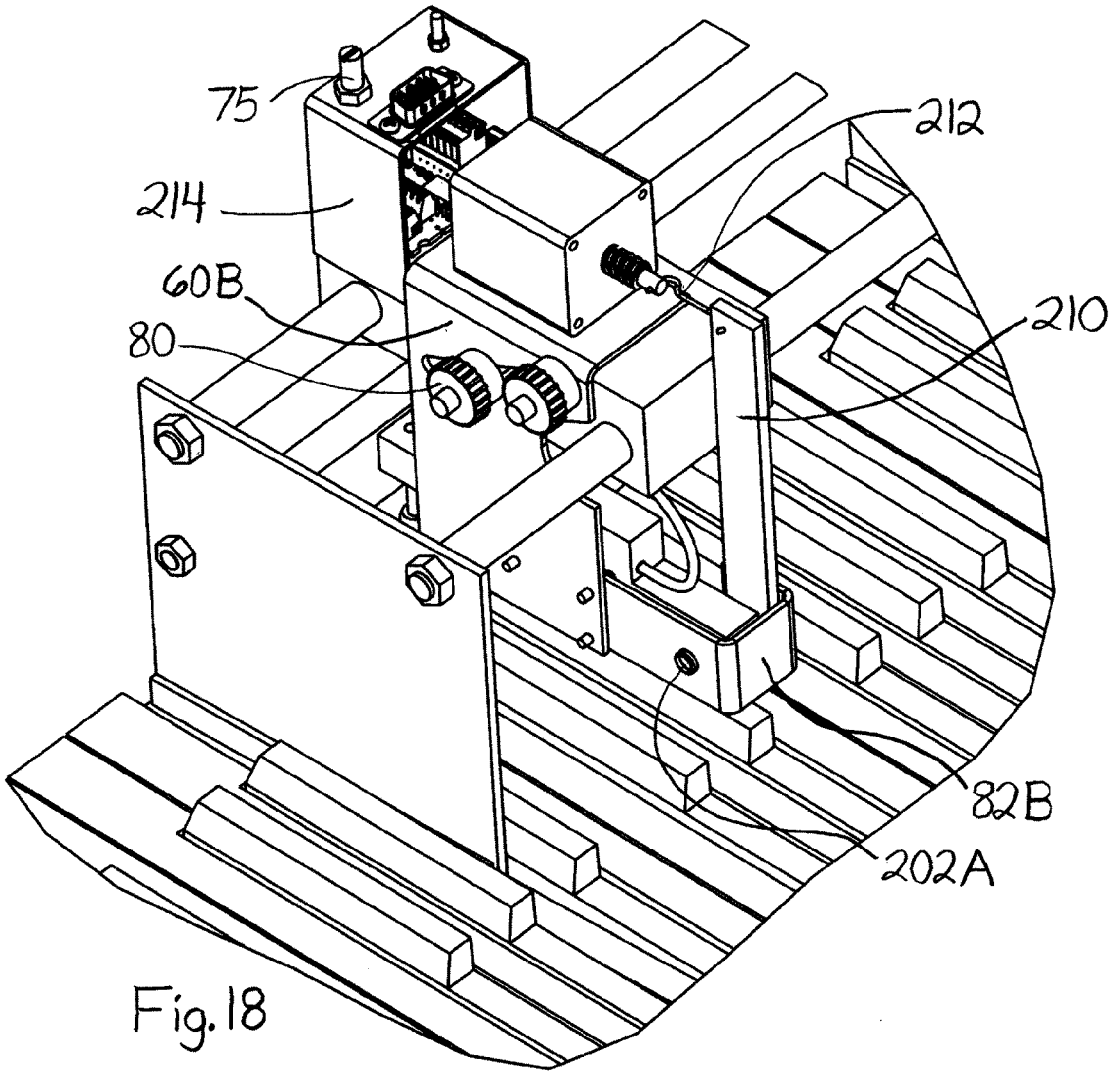
FIG. 18 is a perspective view of a third alternate embodiment device configured for use with and in accordance with certain aspects of the invention, the device being shown as on a keyboard for practicing certain methods of the invention.
Figure 19:
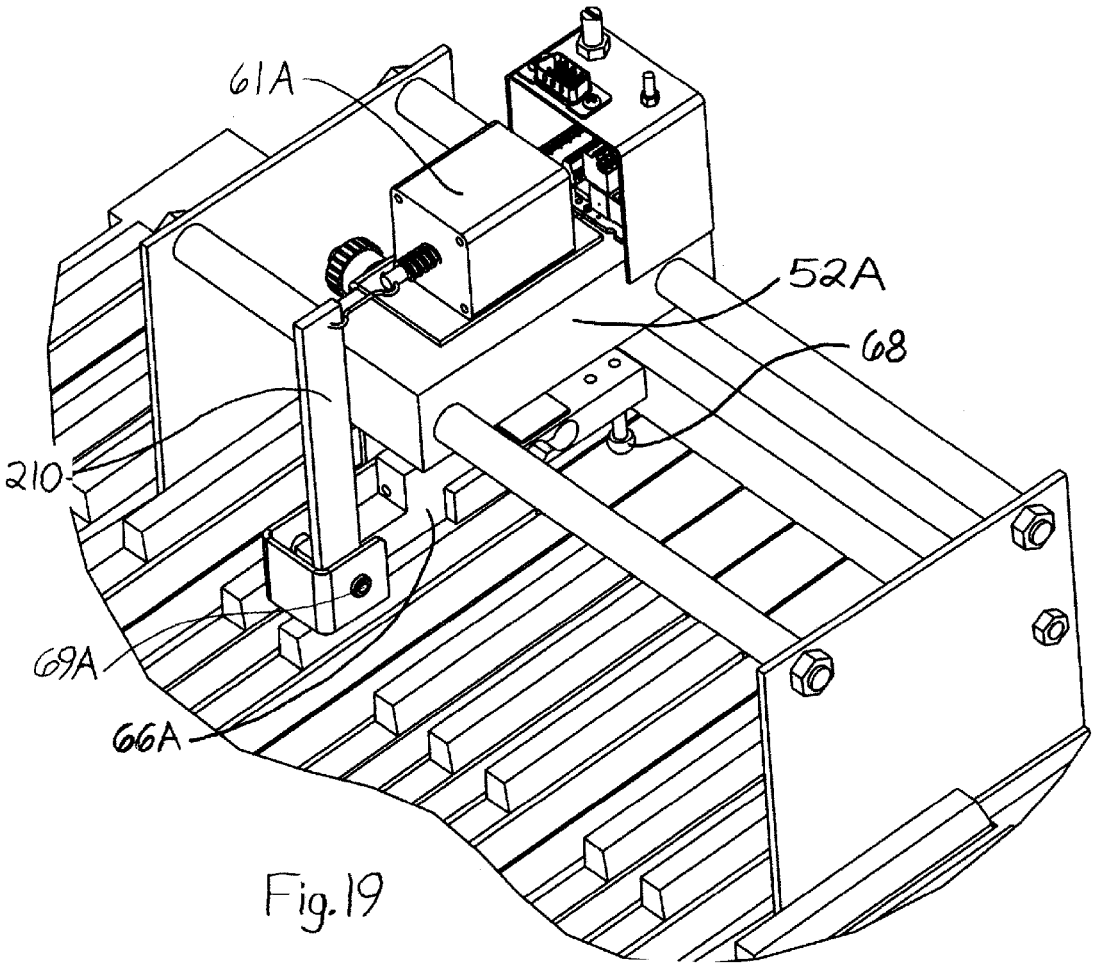
FIG. 19 is an alternate perspective view of the device shown in FIG. 18.

Another embodiment is shown in FIGS. 18 and 19. In this embodiment, a linear motor 61A is used, so that its output shaft translates back and forth. The motor 61A is affixed to the motor support 60B, but is situated above the lower support 52A. The studs 79 are fixed to the lower support 52A, with the knobs 80 tightened to secure the motor support 60B to the lower support 52A. These features provide this embodiment with the same facility in switching from measuring black keys to white keys (or vice versa) as the previous embodiments. That is, the Key-Color-Transition Means is the same. The knobs 80 are loosened, the motor support 60B is slid to its opposite position, and the knobs are tightened again. A flange 210, pointing substantially upwardly, is firmly attached to a follower 66A, so that it rotates as the force transducer 67 and contact 68 rotate, about the arm axis 69A. The follower 66A is shown extending from the arm axis 69A to the force transducer 67, which is affixed to it. The arm 65A in this embodiment is the combination of the flange 210, the follower 66A, the force transducer 67 and the contact 68, which all rotate together as one. The output shaft of motor 61A is coupled to the flange 210 via a small link 212. The translational motion of the shaft is transferred directly to a point near the top of the flange 210, thereby rotating the arm and moving the contact 68 substantially vertically near the key. The arm is supported by a shaft 202A, which is coaxial with the arm axis 69A. A bracket 82B, having two bends in it, supports both ends of shaft 202A. The bracket 82B is firmly attached to the motor support 60B. Radial clearance between the shaft 202A and the follower 66A allows the follower 66A and entire arm 65A to rotate easily. A connector plate 214 is affixed to the front portion of the lower support 52A, with the inamp 78 residing underneath. The potentiometer 75, connector 77 and switch 76 are attached to the connector plate 214. In this embodiment, the vertical movement of the contact 68 during Key Address would be made by slowly incrementing the motor 61A. Similarly, the stopping of the contact's vertical movement during Key Address would be done by ending this motor incrementing. For these actions, there could be one or two "key address" switches, as mentioned in the above embodiments. Or, as also mentioned above, one could have the Key Address movements of the motor begun and carried out automatically, upon completion of Home Address. A variation of these embodiments would also have the controlling program react to the signal from the Key-Rest-Detection Means during Key Address, thus eliminating the need for the manual run-activation switch 76. As soon as the controlling program detected, from the Key-Rest-Detection Means signal, that the contact was barely touching the key in its rest position, it would stop the Key Address movement and begin the actual run. So in these embodiments, the Run-Activation Means would simply consist of the relevant code in the controlling program.

Another variation of the embodiments of FIGS. 18 and 19 would be an even more "manual" means of achieving Key Address. Upon completion of Home Address, the motor power would be turned off, and steps (1a)/(1b) of the Key Address process would be done by manually moving the shaft of the motor 61A in one direction or the other, while observing a Data Display Means that is connected to receive a signal indicative of and display indicia indicative of the signal from the Key Rest Detection Means. The Data Display Means may be implemented, for example, in the display screen of the computer 93, the audio speaker system of the computer, or in a separate analog or digital device capable of providing the operator with visual or audible indicia indicative of the signal from the Key Rest Detection Means. Of course, the Data Display Means can also be connected to receive a signal indicative of and display indicia indicative of any other input or output signal, data measured, analytical results, operational parameters and the like involved or contemplated in the apparatus and the practice of the invention described herein. This manual movement could be accomplished by some sort of threaded member, whose axis was parallel to the motor shaft. During Key Address, the threaded member would butt against one end of the shaft, so that rotating the threaded member caused small movement of the shaft (and therefore, the contact 68). Of course, before the Run began, the threaded member would have to be quickly decoupled from the shaft so the motor could move freely during the run. This threaded member could also be situated to butt against some point near the top of the flange 210 as well, rather than the shaft. But again, it would have to get clear of the flange just before the run began. In lieu of a threaded member, a similar function could be provided by a lever arm, rotating about an axis quite close to one of the shaft ends, or close to the flange end. If the lever arm was sufficiently long, relative to the distance from its rotation axis to either the shaft end or the flange end, then fairly small movements of the contact 68 could be generated as part of Key Address. But again, the lever would have to get clear of both the shaft and the flange 210 before the run began, which could lead to a complicated design. In these embodiments, the Contact-Adjusting Means would consist of the lever or threaded member used to move the motor shaft, thereby moving the contact 68. The Run-Activation Means for this embodiment would likely remain "manual" as well, consisting of the switch 76.

A variation of the embodiments of FIGS. 18 and 19 would have the linear motor 61A oriented so that its output shaft moves substantially vertically. A "button load cell" could be secured to the shaft, possibly touching the key at the AP directly. So the contact 68 in that case would be the button load cell itself. Or the load cell could be sandwiched between a part of the shaft and a separate contact 68. Another variation would include the vertically-oriented motor, but it would be located several inches behind the AP. The motor shaft would excite the rear end of a lever, at a point "Y". The lever would be pivoted about a horizontal axis at a point "Z", with "Z" being somewhere between "Y" and the AP of key 73. So the portion of the lever in front of "Z" could essentially be a cantilevered load cell very similar to many of the other embodiments, with the contact 68 secured to the front of the load cell.

A further embodiment would have a means for automatically sliding the lower support 52 along the rods after each key is measured, putting the contact 68 in the correct "lateral" location for measurement of the next key. This might be done by replacing the two rods 51 with corresponding ball screws (or other linear translating devices), both turned by a third motor. This third motor could be secured to either of the end plates (part of the support structure). This third motor could be coupled to turn the two ball screws directly or indirectly. The lower support 52 would then be threaded for receiving these ball screws, thus ensuring that it slides laterally as the third motor turns. It would also be possible to have only one of the rods 51 replaced by a ball screw (or other linear translation device), with the third motor then turning only one ball screw to move the lower support. In either case, once a given key has been measured by the machine, the controlling program would cause the lower support to automatically slide to the next desired key. This embodiment, when combined with one of the "automatic" contact-adjusting means already described, would allow the keys over large portions of the piano/keyboard to be measured with no operator intervention whatsoever.

All electrical and electronic circuitry and processes contemplated herein may be implemented using convenient functional and operational modules. All methods involving calculations described herein may be carried out via electronic or digital processes using a conventional computer in a conventional manner with all of its conventional components, or a similar cpu-based computing device, via computer-executable instructions, and conventional data manipulation, storage and operations, implemented in the applicable software and programming modules.

DEFINITIONS

For understanding and interpretation of the description of the invention and the claims, except as otherwise noted, certain capitalized terms used herein are defined as follows:

Key Action (also known as Key Mechanism)—all the levers and other components, including the key and the hammer assembly, which convert key movement into hammer head movement; this includes the let-off components, which serve to free the hammer from the other components before the hammer strikes the strings.

Application Point (or A.P.)—a theoretical point on top of the key, usually 10 to 12 mm from the front edge, where gram weights are historically placed, and where the contact of the present invention excites the key.

Grams—In addition to its traditional definition as a unit of mass, it is used here also as a unit of force; the amount of force that gravity exerts at sea-level on a body of a given mass "x" [grams] will also be considered herein as "x" grams of force, or "x" grams-force.

Contact—the portion of the machine that actually touches and moves the keyboard key downwardly and allows the key to move upwardly, while also transmitting the reaction force to the force transducer.

Run—The controlled movement and positioning of the contact near or against the key, not including preparatory movements such as Home Address and Key Address, while simultaneously measuring and recording any reaction forces acting between the contact and the key.

Home Position—any one point in the motor's movement that corresponds to some convenient and predetermined vertical position of the contact, relative to the machine itself. In referring to "home position" herein, one can be referring to either the motor position or the contact position.

Home Address—The process of bringing the motor and contact to Home Position.

Key Address—The process of positioning the contact correctly, in the substantially vertical direction, relative to the "at rest" key, in preparation for a Run. The means used to do this is the Contact-Adjusting Means.

Controlling Program—code which reacts to various inputs (switches closing or opening, data from A/D channels), makes decisions based on these inputs (like starting/stopping motors and initiating A/D sampling), reads in time files and displacement files, moves the motor(s) accurately, and activates various PO's.

Key-Rest Detection Means—Any device, arrangement or means—including the force transducer or a proximity sensor—that generates a signal, or changes its output signal, when the contact either begins touching, begins separating from, or achieves a certain offset from the key. In other words, a means for providing a signal indicative of the relative position between the contact 68 and an at-rest key 73. The signal from the Key-Rest-Detection Means, upon completion of Home Address, may also be used to indicate whether the contact is clear of, or displacing, the key.

Contact-Adjusting Means—the means used to move the contact as part of Key Address.

Arm—a member that includes a contact and a force transducer, and is coupled to a motor. It will normally rotate about some axis, but can also translate with little or no rotation. It can be driven in a variety of ways by the motor, including through a cam/follower arrangement. Its main purpose is to transfer movement of a driver (motor, cam, gear set, etc.) into approximately-vertical movement of the contact.

Follower—a portion of the Arm whose main purpose is to provide rigid support for the force transducer and/or the contact. It rotates with the arm, and may also be driven by the motor via a cam.

Vertical-Translation Means—a specific type of Contact-Adjusting Means, wherein the arm is not rotated to achieve vertical movement of the contact, nor is the main motor (61, 61*a*) pulsed or otherwise activated.

Run-Activation Means—software and/or hardware that causes initiation of a Run, upon successful completion of Key Address.

Key-Color-Transition Means—a means for quickly changing the vertical location and/or fore/aft location of the contact 68 in preparation for addressing the keys of the opposite color Motor Control Means—the software and hardware which provide the signals, necessary for motor output shaft positioning, to the motor or motor/driver combination. It's software is part of the Controlling Program.

Auxiliary Motor—a motor used with a Vertical-Translation Means to move the contact up or down during Key Address without the disturbance associated with turning a knob.—in lieu of a knob—to move the contact up or down during Key Address.

Auxiliary Switch—a switch that is pressed to increment the Auxiliary Motor during Key Address.

Key Address Switch—a switch that is pressed to increment the main motor for performing Key Address, when no Vertical-Translation Means is available.

Time File—a file read in by the controlling program, each line representing the time associated with the corresponding motor step, in order to generate some predetermined Contact Displacement vs. Time curve.

Data Display Means—any means used for producing an output indicative of, or related to, any input or output signal, measured data, analytical results, or operational parameters involved in the apparatus and methods of the invention described herein. It may consist of the display screen of the computer, the audio speaker system of the computer, or a separate device that produces appropriate visual or audible outputs. One of its main functions is to produce, during Key Address, one or more from the group of: (i) visible numbers, which are based directly on the signal from the Key-Rest-Detection Means, (ii) visible symbols, shapes or colors, whose existence and nature is based directly on the signal from the Key-Rest-Detection Means, and (iii) an audible signal, whose presence and nature is based directly on the signal from the Key-Rest-Detection Means.

The invention claimed is:

1. A machine for analyzing a key mechanism, comprising:

a) a contact that moves substantially vertically near the front of the key and transmits any reaction force between said contact and said key, b) a force transducer, coupled to said contact, which senses said reaction force at said contact and provides an output signal indicative of said reaction force, c) a motor with an output shaft coupled to said contact for moving said contact in said substantially vertical manner, d) a motor control means, and e) a means for achieving Home Address, wherein the contact can automatically return to Home Position after each Run is completed.

2. The machine of claim 1, further comprising an arm rotatable about an arm axis, and wherein:

a) said motor output shaft is coupled to said arm for rotation thereof, and b) said arm is coupled to said contact for said substantially vertical movement thereof.

3. The machine of claim 2 wherein said motor is a rotary motor rotatably coupled to said arm.

4. The machine of claim 2 wherein:

a) said motor is a linear motor, and b) said motor output shaft is connected to said arm at a point opposite said contact, relative to said arm axis, whereby said arm is rotated as said motor is activated, resulting in said contact moving substantially vertically near the key.

5. The machine of claim 2 wherein:

a) said motor is a rotary motor, b) said motor output shaft is coupled to said arm via a cam and follower arrangement, c) said follower rotates with said arm, and d) said cam is affixed to and rotates with said motor output shaft, whereby the resulting motion of said contact is substantially vertical, and the rotation of said arm is relatively small compared to the rotation of said motor output shaft.

6. The machine of claim 1, further comprising a Key-Color Transition Means, whereby the contact can be repositioned to aid in switching between white key measurements and black key measurements.

7. The machine of claim 1, further comprising:

a) a Contact-Adjusting Means, and b) a Run-Activation Means, whereby the contact is quickly and easily positioned for performing a run, and the run can be easily and quickly initiated.

8. The machine of claim 7, further comprising:

a) a Data Display Means, and b) a Key Address Switch, whereby Key Address is carried out by manual activation of the motor using said Key Address Switch.

9. The machine of claim 7 wherein the Contact-Adjusting Means includes code in a controlling program that automatically begins activation of the motor output shaft after Home Address is completed.

10. The machine of claim 7 wherein the Run-Activation Means includes code in a controlling program that begins a Run automatically, after indication is received from a Key-Rest-Detection Means that the contact is properly located with respect to the key during Key Address.

11. The machine of claim 7 wherein the Contact-Adjusting Means includes a Vertical-Translation Means, whereby said motor and said contact translate together during Key Address, in said substantially vertical manner.

12. The machine of claim 11, further comprising an auxiliary motor, whereby the vertical translation during Key Address can be accomplished without disturbance to the machine which would be caused by the turning of a knob.

13. The machine of claim 11, further comprising a Data Display Means, whereby Key Address can be manually terminated based on indicators from said Data Display Means.

14. A method of exciting and measuring a keyboard key mechanism, comprising the steps of:

a) displacing the key downwardly at the Application Point, in such a manner that the speed of the Application Point is nearly constant over a significant portion of a downward stroke, and b) simultaneously measuring the forces exerted at the Application Point of the key to create this movement, wherein a force vs. displacement curve and a force vs. time curve can be established from said measured forces during said displacement.

15. The method of claim 14, further comprising:

a) integrating the resulting force vs. displacement curve between any two points of the stroke, b) dividing the result of said integration by the displacement of the Application Point between said two points, whereby an average contact force at the Application Point between said two points of said downward stroke is obtained.

16. The method of claim 14, further comprising:

a) integrating the resulting force vs. time curve between any two points of the stroke, b) dividing the result of said integration by the time elapsed during displacement of the key between said two points, whereby an average contact force at the Application Point during said downward stroke is obtained.

17. The method of claim 14, further comprising calculation of a deviation parameter for one of (i) said force vs. displacement curve and (ii) said force vs. time curve, between any two points of the stroke; whereby an average contact force can be calculated from those curves associated with small deviation parameters of deviation parameters associated with all curves established by repeating said displacing and measuring steps at different speeds.

18. A method of exciting and measuring a keyboard key mechanism, comprising the steps of:

a) displacing a contact upwardly at the Application Point of an initially depressed key, in such a manner that the speed of the contact is nearly constant over a significant portion of an upward stroke, and b) simultaneously measuring the reaction forces between the top of the key and the upwardly-moving contact, wherein a force vs. displacement curve and a force vs. time curve can be established from said measured forces during said displacement.

19. The method of claim 18, further comprising:

a) integrating the resulting force vs. displacement curve between any two points of the stroke, b) dividing the result of said integration by the displacement of the Application Point between said two points, whereby an average contact force at the Application Point between said two points of said upward stroke is obtained.

20. The method of claim 18, further comprising:

a) integrating the resulting force vs. time curve between any two points of the stroke, b) dividing the result of said integration by the time elapsed during displacement of the key between said two points, whereby an average contact force at the Application Point during said upward stroke is obtained.

21. The method of claim 18, further comprising calculation of a deviation parameter for one of (i) said force vs. displacement curve and (ii) said force vs. time curve, between any two points of the stroke; whereby an average contact force can be calculated from those curves associated with small deviation parameters of deviation parameters associated with all curves established by repeating said displacing and measuring steps at different speeds.

22. A method of measuring the key dip of a key action, comprising the steps of:

a) moving a contact downwardly in a predetermined manner to move a key through its downward stroke while simultaneously measuring the reaction force between said contact and said key, b) recording the downward displacement of the key from its at-rest position once said reaction force exceeds a predetermined threshold force value, c) checking the reaction forces as the key continues its displacement downwardly from the recorded key displacement, and d) if the reaction forces begin to decrease as the key continues its displacement downwardly from the recorded key displacement, then repeating said recording and checking steps until the reaction force continues to increase for all displacements downwardly from the last recorded key displacement, e) wherein the key dip is the last recorded displacement.

* * * * *